US008764167B2

(12) United States Patent
Kitada et al.

(10) Patent No.: US 8,764,167 B2
(45) Date of Patent: Jul. 1, 2014

(54) METHOD OF MANUFACTURING LIQUID EJECTING HEAD, LIQUID EJECTING APPARATUS, AND METHOD OF MANUFACTURING PIEZOELECTRIC ELEMENT

(71) Applicant: Seiko Epson Corporation, Tokyo (JP)

(72) Inventors: Kazuya Kitada, Suwa (JP); Xiaoxing Wang, Chino (JP); Koji Sumi, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/775,776

(22) Filed: Feb. 25, 2013

(65) Prior Publication Data

US 2013/0222483 A1 Aug. 29, 2013

(30) Foreign Application Priority Data

Feb. 27, 2012 (JP) ..... 2012-040743

(51) Int. Cl.
*B41J 2/45* (2006.01)

(52) U.S. Cl.
USPC ..... 347/68

(58) Field of Classification Search
USPC ..... 347/68
See application file for complete search history.

(56) References Cited

U.S. PATENT DOCUMENTS

| | | | | |
|---|---|---|---|---|
| 5,198,269 | A * | 3/1993 | Swartz et al. | 427/226 |
| 6,142,615 | A * | 11/2000 | Qiu et al. | 347/70 |
| 2004/0173823 | A1 * | 9/2004 | Murai | 257/252 |
| 2007/0241642 | A1 | 10/2007 | Miyazawa et al. | |
| 2012/0025667 | A1 * | 2/2012 | Horikiri et al. | 310/314 |

FOREIGN PATENT DOCUMENTS

| | | |
|---|---|---|
| JP | 62-154680 | 7/1987 |
| JP | 2001-223404 | 8/2001 |
| JP | 2007-287745 | 11/2007 |

* cited by examiner

*Primary Examiner* — Stephen Meier
*Assistant Examiner* — Alexander D Shenderov
(74) *Attorney, Agent, or Firm* — Harness, Dickey & Pierce, P.L.C.

(57) ABSTRACT

Provided is a method of manufacturing a liquid ejecting head including a pressure generating chamber communicating with a nozzle opening and a piezoelectric element including a piezoelectric layer and an electrode, the method including: forming a first piezoelectric precursor film containing Bi and Fe, or Ba and Ti; forming a first piezoelectric layer by heating and crystallizing the first piezoelectric precursor film; forming a second piezoelectric precursor film further containing at least one selected from Li, B, and Cu on the first piezoelectric layer, in addition to Bi and Fe, or Ba and Ti contained in the first piezoelectric precursor film; and forming the piezoelectric layer by heating and crystallizing the first piezoelectric layer and the second piezoelectric precursor film.

18 Claims, 14 Drawing Sheets

METHOD OF MANUFACTURING LIQUID EJECTING HEAD, LIQUID EJECTING APPARATUS, AND METHOD OF MANUFACTURING PIEZOELECTRIC ELEMENT

The entire disclosure of Japanese Patent Application No. 2012-040743, filed Feb. 27, 2012 is incorporated by reference herein.

BACKGROUND

1. Technical Field

The present invention relates to a method of manufacturing a liquid ejecting head which includes a piezoelectric element including a piezoelectric layer formed of a piezoelectric material and an electrode and discharges liquid droplets from a nozzle opening, a liquid ejecting apparatus, and a method of manufacturing a piezoelectric element.

2. Related Art

As a representative example of the liquid ejecting head, for example, there is an ink jet type recording head in which a part of a pressure generating chamber communicating with a nozzle which discharges ink droplets is configured with a vibrating plate, and the vibrating plate is deformed by a piezoelectric element and ink in the pressure generating chamber is pressurized to discharge as ink droplets from the nozzle. As a piezoelectric element used for the ink jet type recording head, there is a piezoelectric element which is configured to interpose a piezoelectric layer (piezoelectric film) which is formed of a piezoelectric material having an electromechanical transduction function, for example, a crystallized dielectric material, with two electrodes.

A high piezoelectric property is desired for the piezoelectric material used as the piezoelectric layer configuring such piezoelectric element, and as a representative example of the piezoelectric material, lead zirconate titanate (PZT) has been used (see JPA-2001-223404). However, from a viewpoint of environmental concerns, a piezoelectric material without lead or with suppressed content of lead is desired. As a piezoelectric material which does not contain lead, a $BiFeO_3$ based piezoelectric material containing Bi and Fe (see JPA-2007-287745) and a $BaTiO_3$ based piezoelectric material containing Ba and Ti (see JP-A-62-154680) have been known.

However, if the lead-free piezoelectric material containing Bi and Fe, or Ba and Ti described above is used, there has been a problem in that cracks are easily generated such that it is difficult to be used in practice. In addition, not only the ink jet-type recording head, but such problems also occurs in the same manner, in the other liquid ejecting head which discharges liquid droplets other than the ink, and also in a piezoelectric element used for other than the liquid ejecting head.

SUMMARY

An advantage of some aspects of the invention is to provide a method of manufacturing a liquid ejecting head including a piezoelectric element including a piezoelectric layer in which an environmental load is small and generation of cracks is suppressed, a liquid ejecting apparatus, and a method of manufacturing a piezoelectric element.

According to an aspect of the present invention, there is provided a method of manufacturing a liquid ejecting head including a pressure generating chamber communicating with a nozzle opening and a piezoelectric element including a piezoelectric layer and an electrode, the method including: forming a first piezoelectric precursor film containing Bi and Fe, or Ba and Ti; forming a first piezoelectric layer by heating and crystallizing the first piezoelectric precursor film; forming a second piezoelectric precursor film further containing at least one selected from Li, B, and Cu on the first piezoelectric layer, in addition to Bi and Fe, or Ba and Ti contained in the first piezoelectric precursor film; and forming the piezoelectric layer by heating and crystallizing the first piezoelectric layer and the second piezoelectric precursor film.

According to the aspect of the invention, when manufacturing the piezoelectric layer which is formed of a piezoelectric material containing Bi and Fe or a piezoelectric material containing Ba and Ti, the piezoelectric layer is formed by forming the first piezoelectric layer using the first piezoelectric precursor film containing Bi and Fe, or Ba and Ti, and by forming the second piezoelectric precursor film further containing at least one element selected from Li, B, and Cu on the first piezoelectric layer, in addition to Bi and Fe, or Ba and Ti contained in the first piezoelectric precursor film, and thus it is possible to suppress generation of cracks on the piezoelectric layer. In addition, since the piezoelectric layer is formed without lead or content of lead is suppressed, it is possible to reduce a load to the environment.

According to another aspect of the invention, there is provided a liquid ejecting apparatus including the liquid ejecting head manufacturing with the method of manufacturing the liquid ejecting head. According to the aspect of the invention, since the piezoelectric layer on which generation of cracks is suppressed is included, it is possible to obtain a liquid ejecting apparatus with excellent reliability.

In addition, according to still another aspect of the invention, there is a method of manufacturing a piezoelectric element including a piezoelectric layer and an electrode provided on the piezoelectric layer, the method including: forming a first piezoelectric precursor film containing Bi and Fe, or Ba and Ti; forming a first piezoelectric layer by heating and crystallizing the first piezoelectric precursor film; forming a second piezoelectric precursor film further containing at least one selected from Li, B, and Cu on the first piezoelectric layer, in addition to Bi and Fe, or Ba and Ti contained in the first piezoelectric precursor film; and forming the piezoelectric layer by heating and crystallizing the first piezoelectric layer and the second piezoelectric precursor film. According to the aspect of the invention, when manufacturing the piezoelectric layer which is formed of a piezoelectric material containing Bi and Fe or a piezoelectric material containing Ba and Ti, the piezoelectric layer is formed by forming the first piezoelectric layer using the first piezoelectric precursor film containing Bi and Fe, or Ba and Ti, and by forming the second piezoelectric precursor film further containing at least one element selected from Li, B, and Cu on the first piezoelectric layer, in addition to the metal complex containing Bi and Fe, or Ba and Ti contained in the first piezoelectric precursor film, and thus it is possible to suppress generation of cracks on the piezoelectric layer. In addition, since the piezoelectric layer is formed without lead or content of lead is suppressed, it is possible to reduce a load to the environment.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
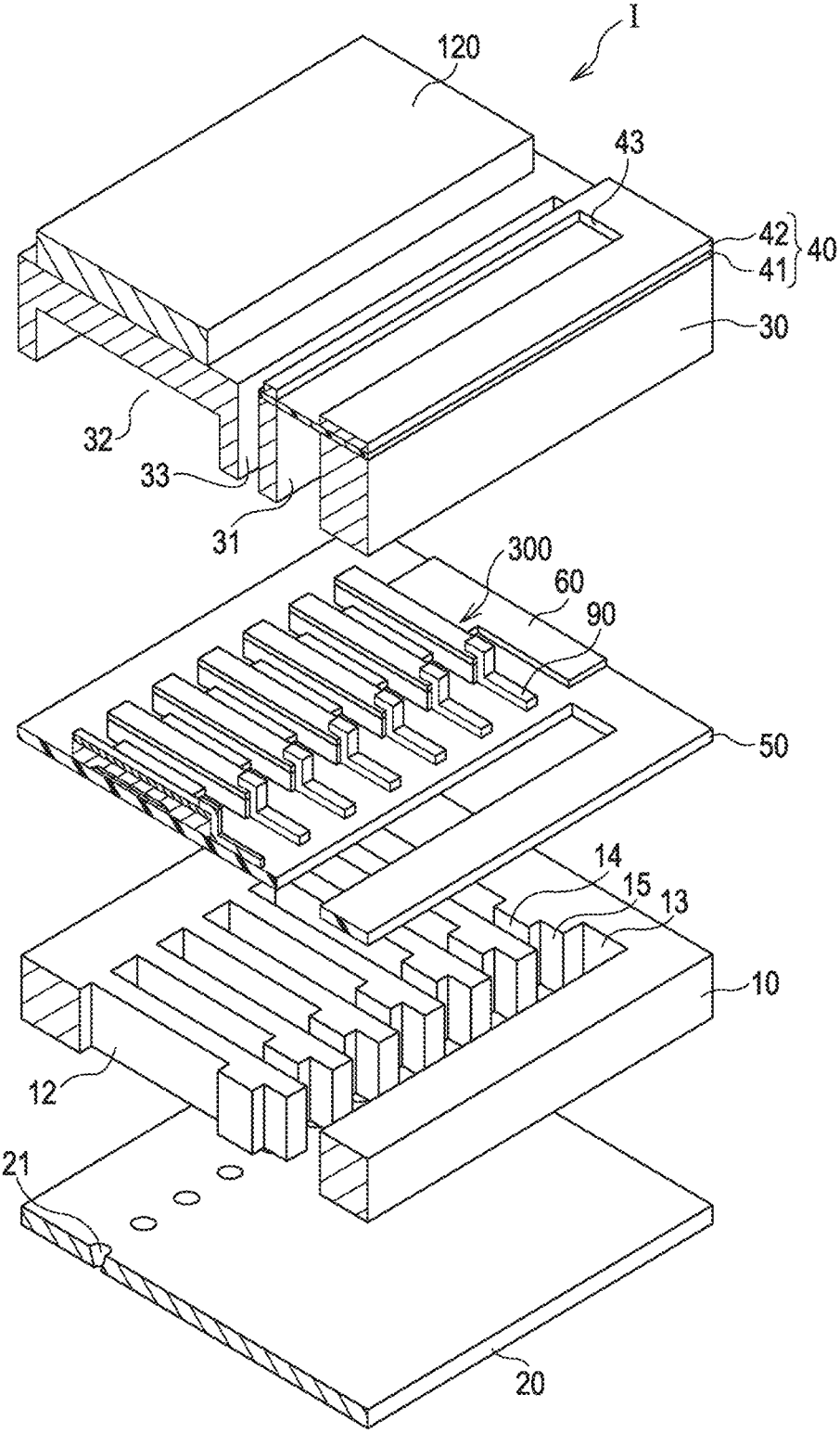
FIG. 1 is an exploded perspective view showing a schematic configuration of a recording head according to Embodiment 1.
Figure 2:
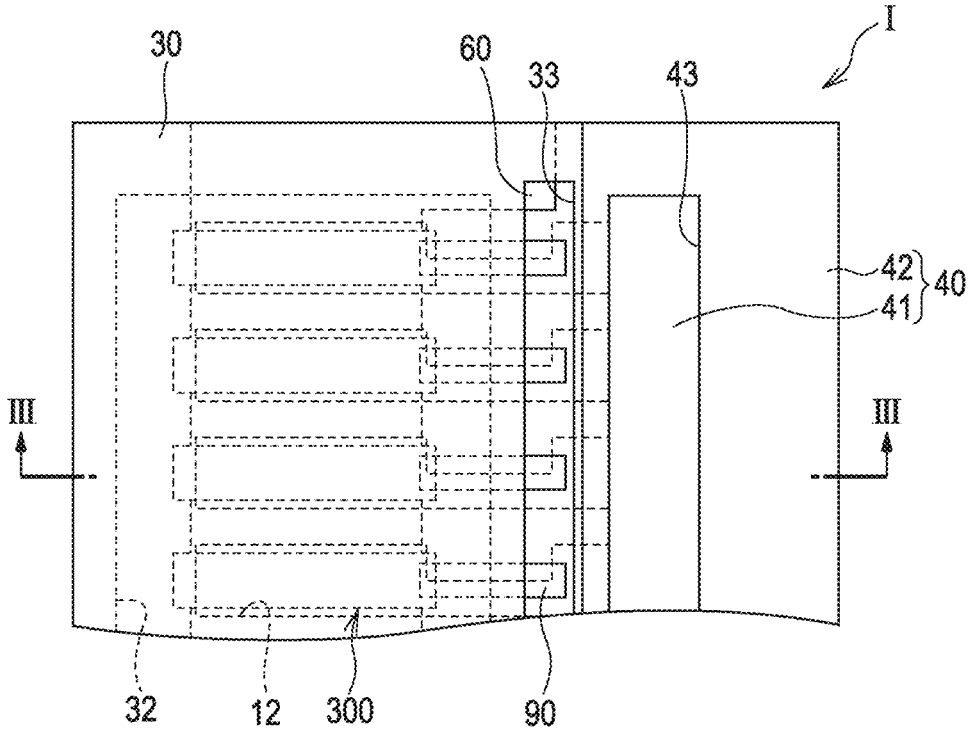
FIG. 2 is a plan view of a recording head according to Embodiment 1.
Figure 3:
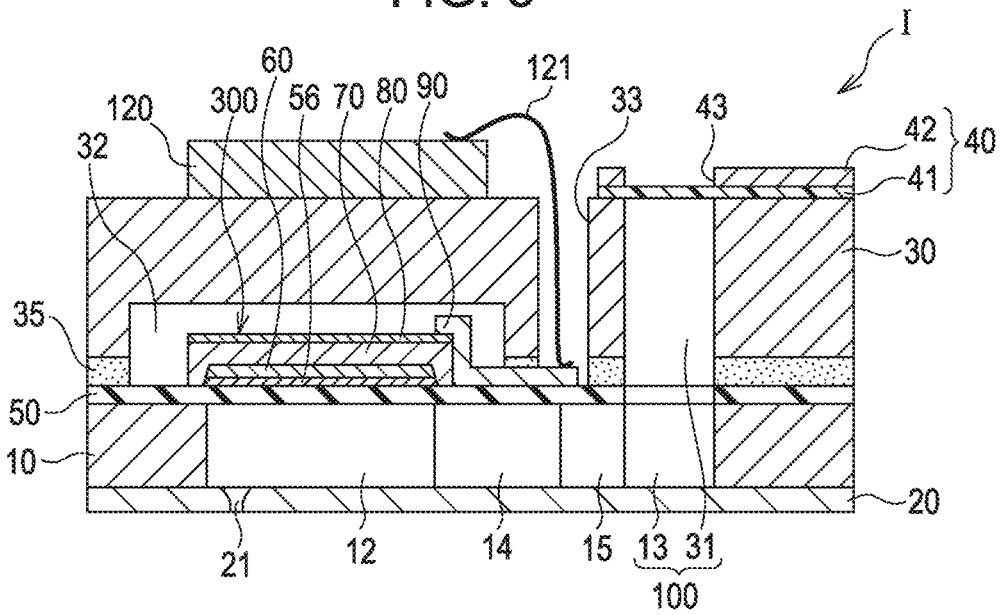
FIG. 3 is a cross-sectional view of a recording head according to Embodiment 1.

FIG. 1 is an exploded perspective view showing a schematic configuration of an ink jet-type recording head which is an example of a liquid ejecting head manufactured with a method of manufacturing according to Embodiment 1 of the invention, FIG. 2 is a plan view of FIG. 1, and FIG. 3 is a cross-sectional view taken along line III-III of FIG. 2. As shown in FIGS. 1 to 3, a flow path forming substrate 10 of the embodiment is formed of a silicon single-crystal substrate, and an elastic film 50 formed of silicon dioxide is formed on one surface thereof.

A plurality of pressure generating chambers 12 are provided in parallel to each other in a width direction on the flow path forming substrate 10. In addition, a communicating unit 13 is formed on a region of outside of a longitudinal direction of the pressure generating chambers 12 of the flow path forming substrate 10, and the communicating unit 13 and each pressure generating chamber 12 are communicated with each other though ink supply paths 14 and communicating paths 15 provided for each pressure generating chambers 12. The communicating unit 13 configures a part of a manifold which is a common ink chamber for each pressure generating chamber 12 by communicating with a manifold unit 31 which is a protection substrate which will be described later. Ink supply paths 14 are formed with a width narrower than the pressure generating chambers 12, and maintains constant flow path resistance of ink flowing from the communicating unit 13 and the pressure generating chamber 12. In addition, in the embodiment, the ink supply path 14 is formed by narrowing the width of the flow path from one side, however, the ink supply path may be formed by narrowing the width of the flow path from both sides. Further, not only narrowing the width of the flow path, the ink supply path may be formed by narrowing from a thickness direction. In the embodiment, a liquid flow path formed of the pressure generating chambers 12, the communicating unit 13, the ink supply paths 14, and the communicating paths 15 is provided on the flow path forming substrate 10.

In addition, a nozzle plate 20 on which nozzle openings 21 communicating with vicinities of end portions on the side opposite to the ink supply paths 14 of each pressure generating chamber 12 is formed, is fixed on a side of an opening surface of the flow path forming substrate 10, by an adhesive, a thermal welding film, or the like. The nozzle plate 20 is formed of glass ceramics, a silicon single-crystal substrate, stainless steel, or the like, for example.

On the other hand, the elastic film 50 is formed as described above, on the side opposite to the opening surface of the flow path forming substrate 10 described above, and an adhesive layer 56 which is formed of titanium oxide with a thickness of 30 nm to 50 nm, for example, and which is for improving adhesiveness with a base of a first electrode 60 of the elastic film 50, is provided on the elastic film 50. In the embodiment, titanium oxide is used for the adhesive layer 56, however, although the material of the adhesive layer 56 varies according to a type of the first electrode 60 and the base thereof, it is possible to use oxide or nitride containing zirconium and aluminum, $SiO_2$, MgO, $CeO_2$, or the like. In addition, an insulating film formed of zirconium oxide or the like may be provided on the elastic film 50, if necessary.

Further, the first electrode 60, a piezoelectric layer 70 which is a thin film with a thickness of equal to or less than 3 μm, preferably from 0.3 μm to 1.5 μm, and a second electrode 80 are laminated and formed on the adhesive layer 56, and a piezoelectric element 300 as a pressure generating unit which generates pressure change of the pressure generating chamber 12 is configured. Herein, the piezoelectric element 300 is referred to a portion including the first electrode 60, the piezoelectric layer 70, and the second electrode 80. In general, one electrode of the piezoelectric element 300 is set as a common electrode, and the other electrode and the piezoelectric layer 70 is configured to be patterned for each pressure generating chamber 12. In the embodiment, the first electrode 60 is a common electrode of the piezoelectric element 300, and the second electrode 80 is set as a separated electrode of the piezoelectric element 300, however, there is no problem to change this due to circumstances of driving circuits or wirings. In addition, herein, the piezoelectric element 300 and a vibrating plate which generates displacement by driving of the piezoelectric element 300 are collectively referred to as an actuator device. In the example described above, the elastic film 50, the adhesive layer 56, the first electrode 60 and, an insulating film which is formed if necessary, are operated as a vibrating plate, however, it is not limited thereto, and the elastic film 50 or the adhesive layer 56 may not be provided, for example. In addition, the piezoelectric element 300 itself may be practically combined with a vibrating plate.

Although will be described in detail later, the piezoelectric layer 70 is manufactured with a method of manufacturing including: forming a first piezoelectric precursor film containing Bi and Fe, or Ba and Ti; forming a first piezoelectric layer by heating and crystallizing the first piezoelectric precursor film; forming a second piezoelectric precursor film further containing at least one selected from Li, B, and Cu on the first piezoelectric layer, in addition to Bi and Fe, or Ba and Ti contained in the first piezoelectric precursor film; and forming the piezoelectric layer by heating and crystallizing the first piezoelectric layer and the second piezoelectric precursor film. In detail, the piezoelectric layer is manufactured with a method of manufacturing including: forming a first piezoelectric precursor film with a first precursor solution including a metal complex containing Bi and Fe or a first precursor solution including a metal complex containing Ba and Ti; forming a first piezoelectric layer by heating and crystallizing the first piezoelectric precursor film; forming a second piezoelectric precursor film with a second precursor solution further including a metal complex containing at least one selected from Li, B and Cu, on the first piezoelectric layer, in addition to the metal complex containing Bi and Fe or the metal complex containing Ba and Ti included in the first precursor solution; and forming a piezoelectric layer by heating and crystallizing the first piezoelectric layer and the second piezoelectric precursor film.

By configuring the piezoelectric layer 70 as described above, as shown in Examples which will be described later, generation of cracks is suppressed. In addition, when manufacturing with the second piezoelectric precursor film containing Li or B, for example, when a solution including a metal complex containing Li or B is used as the second precursor solution, it is possible to obtain a piezoelectric layer 70 with no holes or with less holes. The holes are assumed to be formed when baking. In addition, when manufacturing with the second piezoelectric precursor film containing Li or B, for example, when a solution including a metal complex containing Li or B is used as the second precursor solution, it is possible to obtain a piezoelectric layer 70 including column crystals. When manufacturing with the second piezoelectric precursor film containing Li or Cu, for example, when a solution including a metal complex containing Li or Cu is used as the second precursor solution, it is possible to obtain a piezoelectric layer 70 which performs large displacement, compared to the case of not containing Li or Cu. In addition, when manufacturing with the second piezoelectric precursor film containing B or Cu, for example, when a solution including a metal complex containing B or Cu is used as the second precursor solution, it is possible to improve pressure resistance.

The piezoelectric layer 70 manufactured with the manufacturing method described above is formed of complex oxide which includes bismuth (Bi) and iron (Fe) and has a perovskite structure or a complex oxide which includes barium (Ba) and titanium (Ti) and has a perovskite structure. The piezoelectric layer 70 may be, of course, formed of complex oxide which includes Bi, Fe, Ba, and Ti and has a perovskite structure. Oxygen of A site of the perovskite structure that is, $ABO_3$ type structure, is 12-coordinated and the oxygen of B site thereof is 6-coordinated, and thus, an octahedron is formed. Bi or Ba is positioned in the A site thereof and Fe or Ti is positioned in the B site thereof.

Detail of the structure of the piezoelectric layer 70 is not clear, but it is assumed to have the following structure.

When manufacturing with the method described above with a film containing Bi and Fe as the first piezoelectric precursor film and the second piezoelectric precursor film, that is, when manufacturing with the method described above using a solution including a metal complex containing Bi and Fe, as the first precursor solution and the second precursor solution, a piezoelectric material configuring the piezoelectric layer 70 is a piezoelectric material with bismuth ferrate base which is complex oxide which includes Bi and Fe and has a perovskite structure, and Bi and Fe are positioned in the A site and B site of the perovskite structure, respectively, as described above. The bismuth ferrate is a well-known piezoelectric material having a perovskite structure. Various compositions are known, and for example, for bismuth ferrate, other than $BiFeO_3$, a composition in which an element is partially deficient or excessive, or a part of an element is substituted with another element, is known, however, in a case of mentioning bismuth ferrate in the invention, unless basic properties are not changed, even the composition which is displaced from the stoichiometric composition ($BiFeO_3$) due to a deficient or excessive element (Bi, Fe, or O) is assumed to be included in a range of bismuth ferrate. When manufacturing with the method described above with a film containing Bi and Fe as the first piezoelectric precursor film and the second piezoelectric precursor film, that is, when manufacturing with the method described above using a solution including a metal complex containing Bi and Fe, as the first precursor solution and the second precursor solution, almost the entirety of a complex oxide configuring the piezoelectric layer 70 is bismuth ferrate, and small amounts of Li, B, or Cu are further included therein. Although Li, B, or Cu is included, the piezoelectric layer 70 has a perovskite structure. Li, B, and Cu are assumed to be substituted for a part of Bi of A site or Fe of B site, or to be present on an interface of grain.

In addition, when manufacturing with the method described above with a film containing Ba and Ti as the first piezoelectric precursor film and the second piezoelectric precursor film, that is, when manufacturing with the method described above using a solution including a metal complex containing Ba and Ti, as the first precursor solution and the second precursor solution, a piezoelectric material configuring the piezoelectric layer 70 is a piezoelectric material with barium titanate base which is complex oxide which includes Ba and Ti and has a perovskite structure, and Ba and Ti are positioned in the A site and B site of the perovskite structure, respectively. The barium titanate is a well-known piezoelectric material having a perovskite structure. Various compositions are known, and for example, for barium titanate, other than $BaTiO_3$, a composition in which an element is partially deficient or excessive, or a part of an element is substituted with another element, is known, however, in a case of mentioning barium titanate in the invention, unless basic properties are not changed, even the composition which is displaced from the stoichiometric composition ($BaTiO_3$) due to a deficient or excessive element (Ba, Ti, or O) is assumed to be included in a range of bismuth ferrate. When manufacturing with the method described above with a film containing Ba and Ti as the first piezoelectric precursor film and the second piezoelectric precursor film, that is, when manufacturing with the method described above using a solution including a metal complex containing Ba and Ti, as the first precursor solution and the second precursor solution, almost the entirety of a complex oxide configuring the piezoelectric layer 70 is barium titanate, and small amounts of Li, B, or Cu are further included therein. Although Li, B, or Cu is included, the piezoelectric layer 70 has a perovskite structure. Li, B, and Cu are assumed to be substituted for a part of Ba of A site or Ti of B site, or to be present on an interface of grain.

In addition, when manufacturing with the method described above with a film containing Bi, Fe, Ba and Ti as the first piezoelectric precursor film and the second piezoelectric precursor film, that is, when manufacturing with the method described above using a solution including a metal complex containing Bi, Fe, Ba and Ti, as the first precursor solution and the second precursor solution, a piezoelectric material configuring the piezoelectric layer 70 is formed of a complex oxide which includes Bi, Fe, Ba and Ti and has a perovskite structure, and Bi and Ba are positioned in the A site of the perovskite structure and Fe and Ti are positioned in the B site of the perovskite structure. Such a complex oxide which includes Bi, Fe, Ba, and Ti and has the perovskite structure is shown as a complex oxide having a perovskite structure with mixed crystals of bismuth ferrate and barium titanate, or a solid solution obtained by uniformly dissolving bismuth ferrate and barium titanate. In addition, in x-ray diffraction pattern, bismuth ferrate or barium titanate is not detected as a single material. Herein, as described above, bismuth ferrate or barium titanate is a well-known piezoelectric material having a perovskite structure, respectively. Various compositions are known, and for example, for bismuth ferrate or barium titanate, other than $BiFeO_3$ or $BaTiO_3$, a composition in which an element is partially deficient or excessive, or a part of an element is substituted with another element, is known, however, in a case of mentioning bismuth ferrate or barium titanate in the invention, unless basic properties are not changed, even the composition which is displaced from the stoichiometric composition due to a deficient or excessive element or the composition in which a part of element is substituted by the other element is assumed to be included in a range of bismuth ferrate or barium titanate. When manufacturing with the method described above with a film containing Bi, Fe, Ba, and Ti as the first piezoelectric precursor film and the second piezoelectric precursor film, that is, when manufacturing with the method described above using a solution including a metal complex containing Bi, Fe, Ba, and Ti, as the first precursor solution and the second precursor solution, almost the entirety of a complex oxide configuring the piezoelectric layer 70 is a complex oxide (for example, following Equation (1) or Equation (2)) having a perovskite structure with mixed crystals of bismuth ferrate and barium titanate, and small amounts of Li, B, or Cu are further included therein. Although Li, B, or Cu is included, the piezoelectric layer 70 has a perovskite structure. Li, B, and Cu are assumed to be substituted for a part of Bi and Ba of A site or Fe and Ti of B site, or to be present on an interface of grain.

In addition, Equation (1) can be expressed as Equation (1') and Equation (2) can be expressed as Equation (2'). Herein, notations of Equation (1) and Equation (1'), or notations of Equation (2) and Equation (2') are composition notations based on stoichiometry, and as described above, displacement of an inevitable composition due to lattice mismatch, oxygen deficiency, and the like, and partial substitution of an element are allowed, as long as a perovskite structure is obtained. For example, if a stoichiometric ratio is set as 1, the stoichiometric ratio in a range of 0.85 to 1.20 is allowed. In addition, Equation (2) below is a case in which the first precursor solution or the second precursor solution includes a metal complex further containing Mn or Co, this case is assumed to be a complex oxide of a perovskite structure in that Mn or Co is positioned in B site and Mn or Co is substituted for a part of Fe positioned in B site.

$$(1-x)\,[BiFeO_3]-x[BaTiO_3]\,(0<x<0.40) \quad (1)$$

$$(Bi_{1-x}Ba_x)\,(Fe_{1-x}Ti_x)O_3\ (0<x<0.40) \quad (1')$$

$$(1-x)[Bi(Fe_{1-y}M_y)O_3]-x[BaTiO_3]\,(0<x<0.40,\ 0.01<y<0.09,\ \text{M is Mn or Co}) \quad (2)$$

$$(Bi_{1-x}Ba_x)\,((Fe_{1-y}M_y)_{1-x}Ti_x)O_3\ (0<x<0.40,\ 0.01<y<0.09,\ \text{M is Mn or Co}) \quad (2')$$

In a case in which the piezoelectric layer 70 includes Mn or Co as Equation (2) or Equation (2'), for example, the case of containing Mn is a case where almost the entirety of the complex oxide configuring the piezoelectric layer 70 is a complex oxide including a structure in which a part of Fe of a solid solution obtained by uniformly dissolving bismuth ferrate and barium titanate is substituted by Mn, or a complex oxide having a perovskite structure with mixed crystals of bismuth ferrate manganese and barium titanate, and small amounts of Li, B, or Cu are further included therein. In addition, the basic properties are the same as the properties of further containing small amounts of Li, B, or Cu in a complex oxide having a perovskite structure with mixed crystals of bismuth ferrate and barium titanate, however it is found that a leak property is improved. In addition, also in a case of containing Co, a leak property is improved as in the same manner as Mn. Further, in x-ray diffraction pattern, bismuth ferrate, barium titanate, bismuth ferrate manganese, and bismuth ferrate cobaltate are not detected as a single material.

Lead electrodes 90 formed of gold (Au) or the like, for example, which are extracted from the vicinity of end portion of the ink supply path 14 side and which extend to an upper portion of the elastic film 50 or to an upper portion of the insulating film provided if necessary, are connected to each second electrode 80 which is a separated electrode of the piezoelectric element 300.

A protection substrate 30 including the manifold unit 31 configuring at least a part of a manifold 100 is adhered to the upper portion of the flow path forming substrate 10 on which the piezoelectric element 300 is formed, that is, on the upper portion of the first electrode 60, elastic film 50 or the insulating film provided if necessary, and the lead electrode 90, through an adhesive 35. In the embodiment, the manifold unit 31 penetrates the protection substrate 30 in a thickness direction to be formed in a width direction of the pressure generating chamber 12, and configures the manifold 100 which is a common ink chamber for each pressure generating chamber 12 by communicating with the communicating unit 13 of the flow path forming substrate 10 as described above. In addition, the communicating unit 13 of the flow path forming substrate 10 may be divided into plural units for each pressure generating chamber 12, and only the manifold unit 31 may set as a manifold. Further, for example, only the pressure generating chamber 12 may be provided on the flow path forming substrate 10, and the ink supply path 14 which connects the manifold 100 and each pressure generating chamber 12 to a member (for example, the elastic film 50, the insulting film provided if necessary, or the like) interposed between the flow path forming substrate 10 and the protection substrate 30 may be provided.

In addition, a piezoelectric element holding unit 32 which includes a space in an extent of not disturbing the motion of the piezoelectric element 300 is provided on a region of the protection substrate 30 opposed to the piezoelectric element 300. The piezoelectric element holding unit 32 may be obtained as long as a space in an extent of not disturbing the motion of the piezoelectric element 300 is included, and the space may be hermetically sealed or may not be hermetically sealed.

As the protection substrate 30 described above, a material having substantially the same coefficient of thermal expansion as the flow path forming substrate 10, for example, glass, ceramics or the like is preferably used, and in the embodiment, the protection substrate is formed by using a silicon single-crystal substrate which is the same material as the flow path forming substrate 10.

In addition, a penetration hole 33 which penetrates the protection substrate 30 in the thickness direction is provided on the protection substrate 30. The vicinity of the end portion of the lead electrodes 90 extracted from each piezoelectric element 300 is provided so as to be exposed into the penetration hole 33.

In addition, a driving circuit 120 which drives the piezoelectric element 300 which is provided in parallel is fixed onto the protection substrate 30. As the driving circuit 120, a circuit substrate or a semiconductor integrated circuit (IC) can be used, for example. In addition, the driving circuit 120 and the lead electrodes 90 are electrically connected to each other through a connection wire 121 formed of a conductive wire such as a bonding wire, or the like.

In addition, a compliance substrate 40 formed of a sealing film 41 and a fixing plate 42 is adhered to the upper portion of the protection substrate 30 described above. Herein, the sealing film 41 is formed of a material having low rigidity, and flexibility, and one surface of the manifold unit 31 is sealed by the sealing film 41. In addition, the fixing plate 42 is formed with a relatively hard material. Since a region of the fixing plate 42 opposing to the manifold 100 is an opening portion 43 where the plate is completely removed in the thickness direction, one surface of the manifold 100 is sealed by only the sealing film 41 having flexibility.

In an ink jet-type recording head I of the embodiment, after introducing ink from an ink feeding port connected to an external ink supply unit (not shown) and filling the inner portion from the manifold 100 to the nozzle opening 21 with the ink, voltage is applied between each of the first electrodes 60 and the second electrodes 80 corresponding to pressure generating chambers 12 according to a recording signal from the driving circuit 120, pressure inside each pressure generating chamber 12 is increased by flexural deformation of the elastic film 50, the adhesive layer 56, the first electrode 60, and the piezoelectric layer 70, and ink droplets are discharged from the nozzle opening 21.

Next, an example of a method of manufacturing the ink jet-type recording head of the embodiment will be described with reference to FIGS. 4A to 8B. FIGS. 4A to 8B are cross-sectional views of a pressure generating chamber in a longitudinal direction.

Figure 4A:
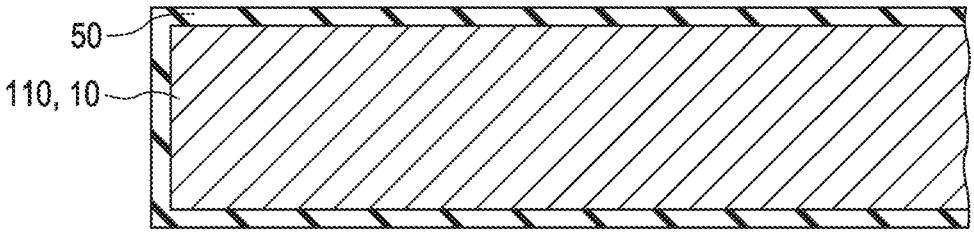
FIGS. 4A and 4B are cross-sectional views showing a manufacturing step of a recording head according to Embodiment 1.

First, as shown in FIG. 4A, a silicon dioxide film formed of silicon dioxide ($SiO_2$) configuring the elastic film 50 is formed on a surface of a wafer 110 for a flow path forming substrate which is a silicon wafer by thermal oxidation. In addition, in a case in which insulating film (not shown) formed of zirconium oxide or the like is provided on the elastic film 50 or the like, it is possible to form a silicon dioxide film by a reactive sputtering method, thermal oxidation or the like.

Figure 4B:
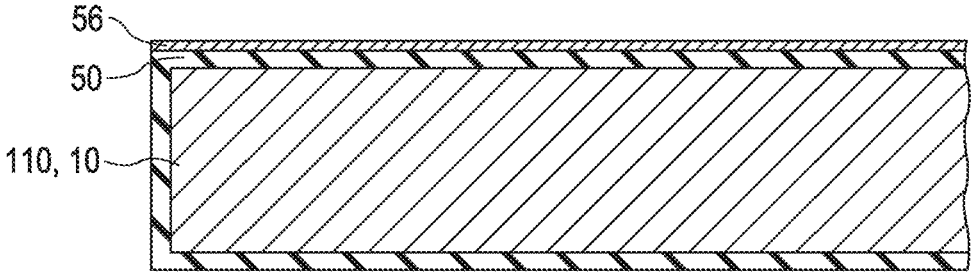

Next, as shown in FIG. 4B, the adhesive layer 56 formed of titanium oxide or the like is formed on the elastic film 50 (silicon dioxide film) or on the insulating film in a case where the insulating film is provided, by a sputtering method, thermal oxidation or the like.

Figure 5A:
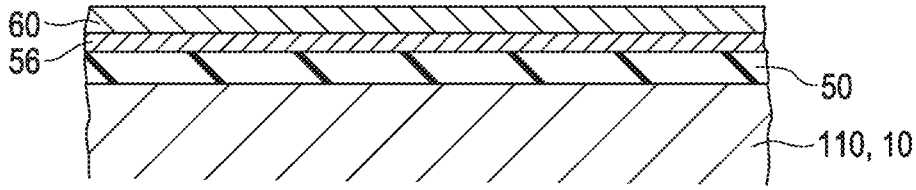
FIGS. 5A to 5D are cross-sectional views showing a manufacturing step of a recording head according to Embodiment 1.
Figure 5B:
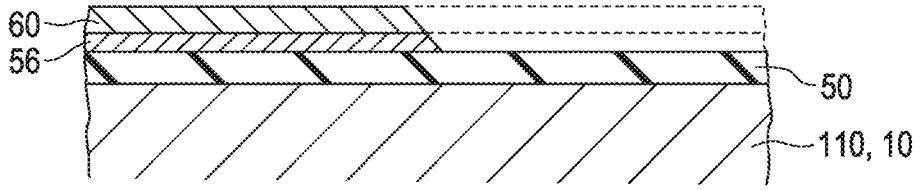

Then, as shown in FIG. 5A, the first electrode 60 formed of platinum, iridium, iridium oxide, or a laminated structure thereof, is formed on the adhesive layer 56 by a sputtering method, a deposition method, thermal oxidation or the like. Next, as shown in FIG. 5B, a resist (not shown) having a predetermined shape is patterned at the same time so that side surfaces of the adhesive layer 56 and the first electrode 60 are inclined, as a mask on the first electrode 60.

Then, after peeling off the resist, the piezoelectric layer 70 is laminated on the first electrode 60 with a method of manufacturing including: forming a first piezoelectric precursor film containing Bi and Fe, or Ba and Ti; forming a first piezoelectric layer by heating and crystallizing the first piezoelectric precursor film; forming a second piezoelectric precursor film further containing at least one selected from Li, B, and Cu on the first piezoelectric layer, in addition to Bi and Fe, or Ba and Ti contained in the first piezoelectric precursor film; and forming the piezoelectric layer by heating and crystallizing the first piezoelectric layer and the second piezoelectric precursor film. For example, it is possible to manufacture the piezoelectric layer 70 with a chemical solution method such as a MOD (Metal-Organic Decomposition) method by which the piezoelectric layer formed of metal oxide is obtained by applying and drying a precursor solution containing a metal complex and baking at a high temperature, or a sol-gel method. Other than that, it is possible to manufacture piezoelectric layer 70 even with a gas phase method, a liquid phase method, or solid phase method such as a laser ablation method, a sputtering method, a pulse laser deposition method (PLD method), a CVD method, an aerosol deposition method, or the like.

As a detailed formation procedure example in a case of forming the piezoelectric layer 70 by a chemical solution method, firstly, after forming a first piezoelectric precursor film 71*a* on the first electrode 60 using a first precursor solution including a metal complex containing Bi and Fe or a first precursor solution including a metal complex containing Ba and Ti, the first piezoelectric layer 71 is formed by heating and crystallizing the first piezoelectric precursor film.

Figure 5C:
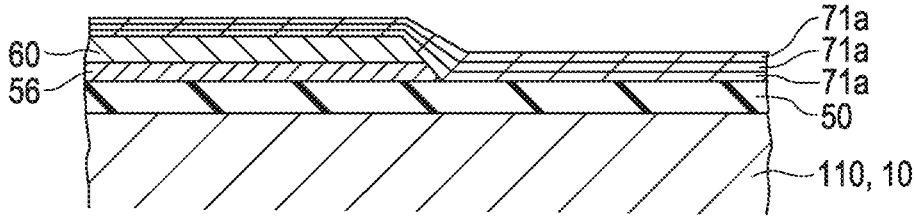

As a detailed formation procedure example of the first piezoelectric layer 71, as shown in FIG. 5C, firstly, the first piezoelectric precursor film 71*a* is formed by applying a first precursor solution including a metal complex containing Bi and Fe or a first precursor solution including a metal complex containing Ba and Ti with a spin coating method or the like on the first electrode 60 (first piezoelectric layer applying step).

The first precursor solution to be applied is a solution obtained by dissolving or dispersing a mixture obtained by mixing a metal complex containing Bi and Fe, in an organic solvent, or a solution obtained by dissolving or dispersing a mixture obtained by mixing a metal complex containing Ba and Ti, in an organic solvent. A solution obtained by dissolving or dispersing a mixture obtained by mixing a metal complex containing Bi, Fe, Ba, and Ti, in an organic solvent may also be used as a first precursor solution. In addition, a solution further containing a metal complex including Mn, Co, or the like may be used as a first precursor solution. A mixing ratio of each metal complex may be a ratio to be mixed so that each metal has a desired molar ratio. Alkoxide, organic salt, β diketone complex, or the like of each metal can be used as the metal complex, for example. As a metal complex including Bi, bismuth 2-ethylhexanoate, bismuth acetate, or the like is used, for example. As a metal complex including Fe, iron 2-ethylhexanoate, iron acetate, iron (III) acetylacetonate, or the like is used, for example. As a metal complex including Ba, barium isopropoxide, barium 2-ethylhexanoate, barium acetylacetonate, or the like is used, for example. As a metal complex including Ti, titanium isopropoxide, titanium 2-ethylhexanoate, titanium (di-i-propoxide)bis(acetylacetonate), or the like is used, for example. As a metal complex including Mn, manganese 2-ethylhexanoate, manganese acetate, or the like is used, for example. As an organic metal complex including Co, cobalt 2-ethylhexanoate, cobalt (III) acetylacetonate, or the like is used, for example. As a metal complex contained in a precursor solution, a metal complex including one metal such as Bi, Fe, Ba, or Ti may also be used, or a metal complex including two or more metals thereof may also be used. In addition, as a solution of a first precursor solution, propanol, butanol, pentanol, hexanol, octanol, ethylene glycol, propylene glycol, octane, decane, cyclohexane, xylene, toluene, tetrahydrofuran, acetic acid, propionic acid, octyl acid, or the like is used.

Then, the first piezoelectric precursor film 71*a* is heated at a predetermined temperature (for example, 130° C. to 250° C.), and dried for a given time (first piezoelectric layer drying step). Next, degreasing is performed by heating the dried first piezoelectric precursor film 71*a* at a predetermined temperature (for example, 300° C. to 450° C.) and holding for a given time (first piezoelectric layer degreasing step). The degreasing herein is separating organic components included in the first piezoelectric precursor film 71*a* as $NO_2$, $CO_2$, $H_2O$, for example. An atmosphere in the drying step or degreasing step is not limited, and may be atmospheric air, an oxygen atmosphere, or inert gas. In addition, the first piezoelectric layer applying step, the first piezoelectric layer drying step, and the first piezoelectric layer degreasing step may be performed once for each, however, the first piezoelectric layer applying step, the first piezoelectric layer drying step, or the first piezoelectric layer degreasing step may be performed several times. In FIGS. 5A to 5D, a set of steps of the first piezoelectric layer applying step, the first piezoelectric layer drying step, and the first piezoelectric layer degreasing step is performed three times, and three first piezoelectric precursor films 71*a* are laminated.

Figure 5D:
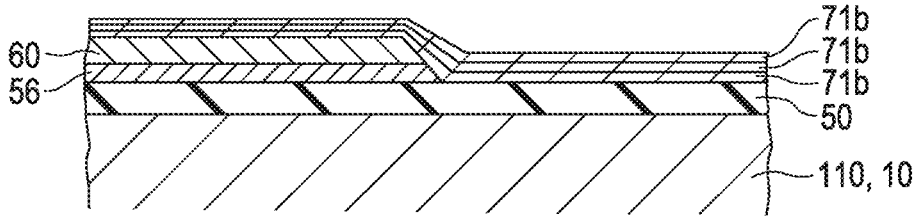
Figure 6A:
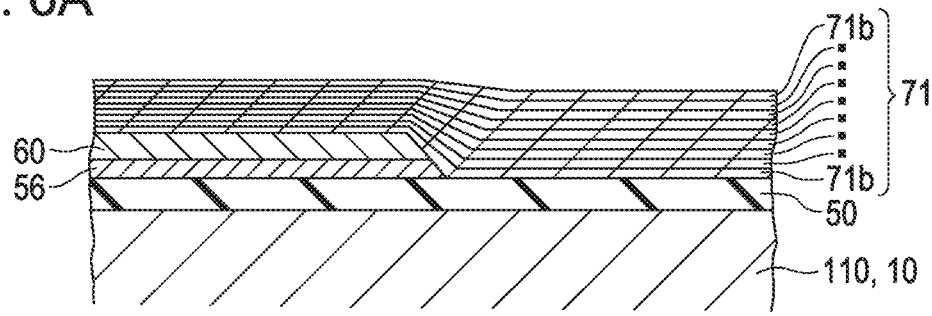
FIGS. 6A to 6C are cross-sectional views showing a manufacturing step of a recording head according to Embodiment 1.

Next, as shown in FIG. 5D, the first piezoelectric precursor film 71*a* is heated at a predetermined temperature, for example, 600° C. to 850° C., and crystallized by being held for a given time, for example, for 1 to 15 minutes, such that a first piezoelectric layer 71*b* formed of complex oxide which includes Bi and Fe, or Ba and Ti and has a perovskite structure, is formed (first piezoelectric layer baking step). In the embodiment, since a plurality of first piezoelectric precursor films 71*a* are provided and an operation of baking thereof is collectively performed several times, as shown in FIG. 6A, a first piezoelectric layer 71 which is formed of a plurality of first piezoelectric films 71*b*, is formed. Also in the first piezoelectric layer baking step, an atmosphere is not limited, and may be atmospheric air, an oxygen atmosphere, or inert gas. As a heating apparatus used in the first piezoelectric layer drying step, the first piezoelectric layer degreasing step, and the first piezoelectric layer baking step, an RTA (Rapid Thermal Annealing) apparatus which heats by emitting an infrared lamp or a hot plate is used, for example.

In addition, when forming the first piezoelectric layer 71 formed of the plurality of first piezoelectric films 71*b*, the plurality of layers may be collectively baked after repeating the first piezoelectric layer applying step, the first piezoelectric layer drying step, and the first piezoelectric layer degreasing step as described above, however, the plurality of layers may also be laminated by sequentially performing the first piezoelectric layer applying step, the first piezoelectric layer drying step, the first piezoelectric layer degreasing step, and the first piezoelectric layer baking step. In addition, in the embodiment, the first piezoelectric films 71*b* are provided to be laminated, however, only one layer may be provided.

Figure 6B:
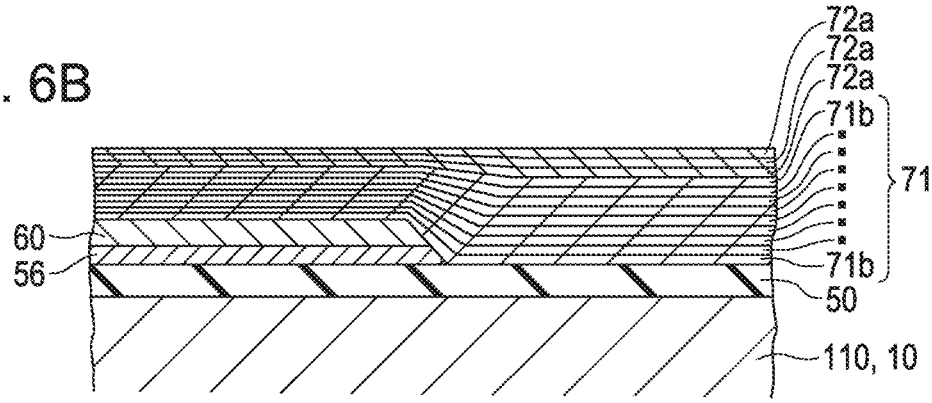

Then, a second piezoelectric precursor film 72*a* is formed on the first piezoelectric layer 71 with a second precursor solution further including a metal complex containing at least one selected from Li, B, and Cu, in addition to a metal complex containing Bi and Fe or a metal complex containing Ba and Ti included in the first precursor solution. As a detailed formation procedure example of the second piezoelectric precursor film 72*a*, as shown in FIG. 6B, the second piezoelectric precursor film 72*a* is formed by applying the second precursor solution on the first electrode 60 using a spin coating method, or the like (second piezoelectric layer applying step).

In a case of using a solution including a metal complex containing Bi and Fe as a first precursor solution, a solution including a metal complex containing Bi and Fe and a metal complex containing at least one selected from Li, B, and Cu, is used as a second precursor solution. In addition, in a case of using a solution including a metal complex containing Ba and Ti as a first precursor solution, a solution including a metal complex containing Ba and Ti and a metal complex containing at least one selected from Li, B, and Cu, is used as a second precursor solution. Further, in a case of using a solution including a metal complex containing Bi, Fe, Ba and Ti as a first precursor solution, a solution including a metal complex containing Bi, Fe, Ba, and Ti and a metal complex containing at least one selected from Li, B, and Cu, is used as a second precursor solution. For example, the second precursor solution can be a solution obtained by further adding a metal complex containing at least one selected from Li, B, and Cu, to the first precursor solution. In addition, a solution containing a metal complex including Mn or Co may be set as a second precursor solution. The second precursor solution is obtained by dissolving or dispersing a mixture obtained by mixing each metal complex, in an organic solvent. A mixing ratio of each metal complex may be a ratio to be mixed so that each metal has a desired molar ratio. For example, a molar ratio of Li is preferably to be 1.0 mol % to 10 mol %, a molar ratio of B is preferably to be 1.0 mol % to 10 mol %, and a molar ratio of Cu is preferably to be 0.5 mol % to 10 mol %, with respect to a total molar quantity of A site element such as Bi or Ba, or a total molar quantity of B site element such as Fe, Ti, or Mn. Alkoxide, organic salt, β diketone complex, or the like of each metal can be used as the metal complex, for example. As a metal complex including Bi, bismuth 2-ethylhexanoate, bismuth acetate, or the like is used, for example. As a metal complex including Fe, iron 2-ethylhexanoate, iron acetate, tris(acetylacetonate) iron, or the like is used, for example. As a metal complex including Ba, barium isopropoxide, barium 2-ethylhexanoate, barium acetylacetonate, or the like is used, for example. As a metal complex including Ti, titanium isopropoxide, titanium 2-ethylhexanoate, titanium (di-i-propoxide)bis(acetylacetonate), or the like is used, for example. As a metal complex including Mn, manganese 2-ethylhexanoate, manganese acetate, or the like is used, for example. As a metal complex including Co, cobalt 2-ethylhexanoate, cobalt (III) acetylacetonate, or the like is used, for example. As a metal complex including Li, lithium 2-ethylhexanoate or the like is used, for example. As a metal complex including B, boron 2-ethylhexanoate or the like is used, for example. As a metal complex including Cu, copper 2-ethylhexanoate or the like is used, for example. As a metal complex contained in a precursor solution, a metal complex including one metal such as Bi, Fe, Ba, Ti, Li, B, or Cu may also be used, or a metal complex including two or more metals thereof may also be used. In addition, as a solution of a second precursor solution, propanol, butanol, pentanol, hexanol, octanol, ethylene glycol, propylene glycol, octane, decane, cyclohexane, xylene, toluene, tetrahydrofuran, acetic acid, propionic acid, octyl acid, or the like is used.

Then, the second piezoelectric precursor film 72*a* is heated at a predetermined temperature (for example, 150° C. to 250° C.), and dried for a given time (second piezoelectric layer drying step). Next, degreasing is performed by heating the dried second piezoelectric precursor film 72*a* at a predetermined temperature (for example, 300° C. to 450° C.) and holding for a given time (second piezoelectric layer degreasing step). The degreasing herein is separating organic components included in the second piezoelectric precursor film 72*a* as $NO_2$, $CO_2$, $H_2O$, for example. An atmosphere in the second piezoelectric layer drying step or the second piezoelectric layer degreasing step is not limited, and may be atmospheric air, an oxygen atmosphere, or inert gas. In addition, the second piezoelectric layer applying step, the second piezoelectric layer drying step, and the second piezoelectric layer degreasing step may be performed once for each, however, the second piezoelectric layer applying step, the second piezoelectric layer drying step, or the second piezoelectric layer degreasing step may be performed several times. In FIG. 6B, a set of steps of the second piezoelectric layer applying step, the second piezoelectric layer drying step, and the second piezoelectric layer degreasing step is performed three times, and three second piezoelectric precursor films 72*a* are laminated.

Figure 6C:
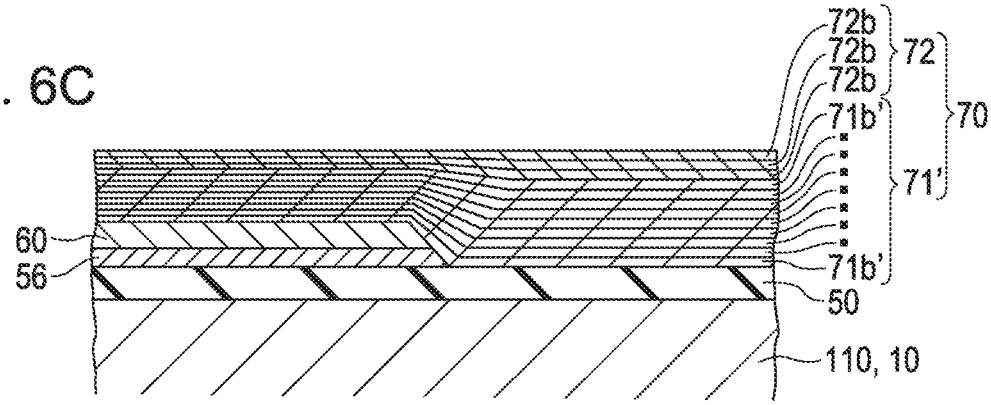

Next, as shown in FIG. 6C, the second piezoelectric precursor film 72*a* is heated at a predetermined temperature, for example, 600° C. to 850° C., and crystallized by being held for a given time, for example, for 1 to 15 minutes, such that second piezoelectric films 72*b* formed of a complex oxide having a perovskite structure are formed (second piezoelectric layer baking step). In FIGS. 6A to 6C, since a plurality of second piezoelectric precursor films 72*a* are provided, a second piezoelectric layer 72 formed of the plurality of second piezoelectric films 72*b* is formed.

An atmosphere in the second piezoelectric layer baking step is not limited, and may be atmospheric air, an oxygen atmosphere, or inert gas. As a heating apparatus used in the second piezoelectric layer drying step, the second piezoelectric layer degreasing step, and the second piezoelectric layer baking step, an RTA apparatus which heats by emitting an infrared lamp or a hot plate is used, for example. In addition, when forming the second piezoelectric layer 72 formed of the plurality of second piezoelectric films 72*b*, the plurality of layers may be collectively baked after repeating the second piezoelectric layer applying step, the second piezoelectric layer drying step, and the second piezoelectric layer degreasing step as described above, however, the plurality of layers may also be laminated by sequentially performing the second piezoelectric layer applying step, the second piezoelectric layer drying step, the second piezoelectric layer degreasing step, and the second piezoelectric layer baking step. In addition, in the embodiment, the second piezoelectric films 72*b* are provided to be laminated, however, only one layer may be provided.

In a step of heating and crystallizing the second piezoelectric precursor films 72*a* (second piezoelectric layer baking step), the first piezoelectric films 71*b* which are the lower layers of the second piezoelectric precursor films 72*a* are also heated, and becomes first piezoelectric films 71*b*'. If the first piezoelectric films 71*b* are heated at the same time of heating the second piezoelectric precursor films 72*a* formed on the first piezoelectric films as described above, the first piezoelectric films 71*b* become a liquid phase, and Li, B, or Cu which is an element configuring the second piezoelectric precursor films 72*a* is diffused to the first piezoelectric films 71*b* which become a liquid phase, and, it is assumed that the entire first piezoelectric films 71*b* which become a liquid phase and the second piezoelectric precursor films 72*a* are crystallized. It is assumed that cracks or holes generated in the stage of manufacture of the first piezoelectric films 71*b* are filled with the diffused element described above. Since the first piezoelectric films 71*b* become a liquid phase when heating and crystallizing the second piezoelectric precursor films 72*a* as described above, and a metal element included in the first precursor solution and a metal element included in the second precursor solution are common, as shown in Examples which will be described later, the obtained piezoelectric layer 70 is a single-layered piezoelectric layer in which crystals are continuously grown so that a boundary thereof is not observed.

In FIGS. 6A to 6C, or the like, it is stated that the piezoelectric layer 70 to be manufactured is configured with a first piezoelectric layer 71' obtained by laminating the first piezoelectric films 71*b'* obtained by further heating the first piezoelectric films 71*b*, and the second piezoelectric layer 72 obtained by laminating second piezoelectric films 72*b* formed using the second precursor solution, however, this is disclosed for convenience for simple description of the manufacturing method. As described above, the piezoelectric layer 70 to be manufactured in practice is configured with a single layer in which crystals are continuously grown so that a boundary thereof is not observed, and it is difficult to visually differentiate the first piezoelectric layer 71' and the second piezoelectric layer 72.

As described above, after forming the first piezoelectric layer 71 with the predetermined first piezoelectric precursor films, and forming the predetermined second piezoelectric precursor films 72*a* containing Li, B, or Cu on the first piezoelectric layer 71, in the piezoelectric layer 70 obtained with a manufacturing method by heating and crystallizing, generation of cracks is suppressed as shown in Examples which will be described later. In addition, when manufacturing with the second piezoelectric precursor film containing Li or B, it is possible to manufacture the piezoelectric layer 70 having no holes or with less holes. It is assumed that the holes are formed in a baking step. In addition, when manufacturing with the second piezoelectric precursor film containing Li or B, it is possible to manufacture the piezoelectric layer 70 having columnar crystals. When manufacturing with the second piezoelectric precursor film containing Li or Cu, it is possible to manufacture the piezoelectric layer 70 having a larger amount of displacement, compared to a case of not containing Li or Cu. In addition, when manufacturing with the second piezoelectric precursor film containing B or Cu, it is possible to manufacture the piezoelectric layer 70 with improved pressure resistance.

After forming piezoelectric layer 70 as described above, as shown in FIG. 7A, the second electrode 80 formed of platinum or the like is formed on the piezoelectric layer 70 with a sputtering method or the like, and the piezoelectric layer 70 and the second electrode 80 are patterned on a region opposing to each pressure generating chamber 12 at the same time, to form the piezoelectric element 300 including the first electrode 60, the piezoelectric layer 70, and the second electrode 80. The patterning of the piezoelectric layer 70 and the second electrode 80 can be collectively performed by dry etching through a resist (not shown) formed in a predetermined shape. After that, post annealing may be performed at a temperature of 600° C. to 800° C., if necessary. Accordingly, it is possible to form an excellent boundary of the piezoelectric layer 70 and the first electrode 60 or the second electrode 80, and it is possible to improve crystallinity of the piezoelectric layer 70.

Figure 7A:
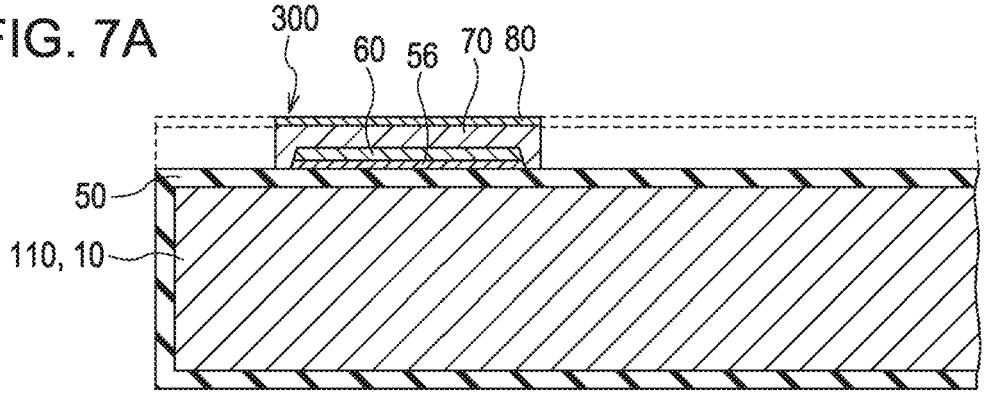
FIGS. 7A to 7C are cross-sectional views showing a manufacturing step of a recording head according to Embodiment 1.
Figure 7B:
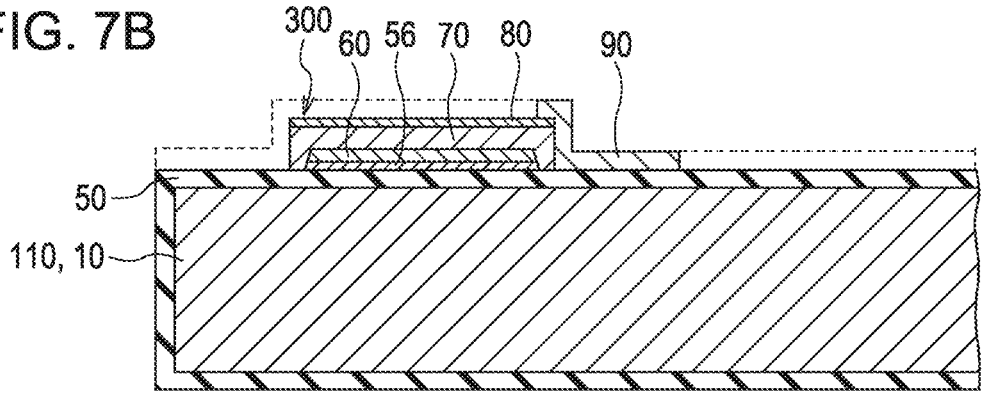

Next, as shown in FIG. 7B, after forming the lead electrode 90 formed of gold (Au) or the like, for example, over the entire surface of the wafer 110 for a flow path forming substrate, each piezoelectric element 300 is patterned with a mask pattern (not shown) formed of a resist or the like, for example.

Figure 7C:
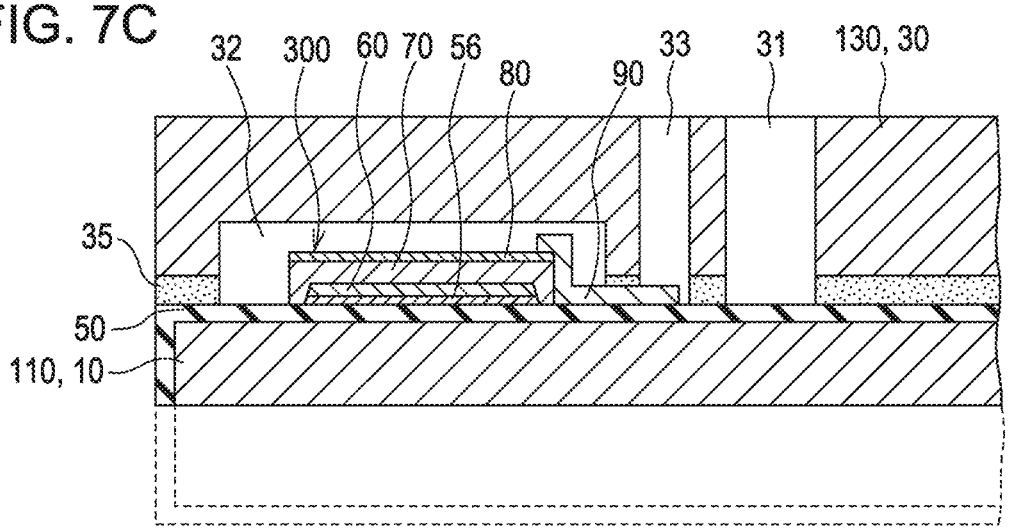

Next, as shown in FIG. 7C, after adhering a wafer 130 for a protection substrate which is a silicon wafer and a plurality of protection substrates 30, on the piezoelectric element 300 side of the wafer 110 for a flow path forming substrate, with the adhesive 35, the wafer 110 for a flow path forming substrate is set to be thin as a predetermined thickness.

Figure 8A:
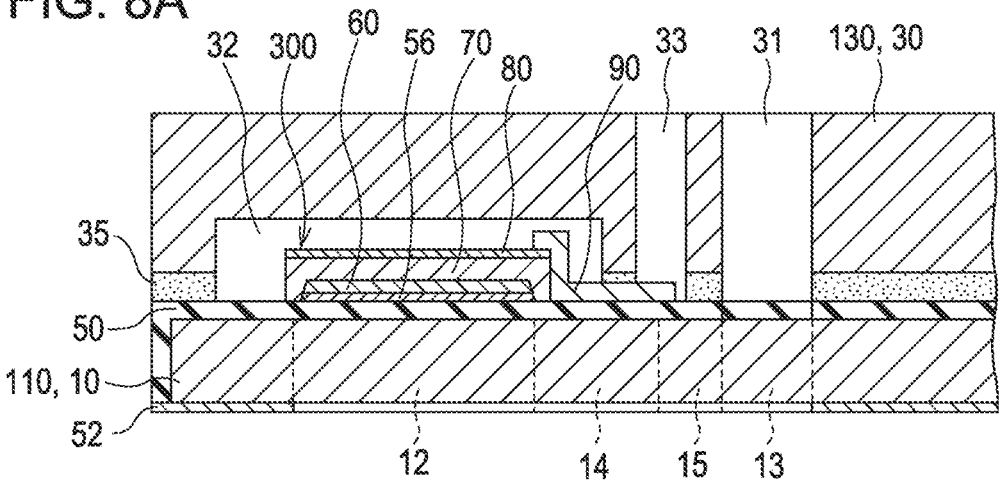
FIGS. 8A and 8B are cross-sectional views showing a manufacturing step of a recording head according to Embodiment 1.

Then, as shown in FIG. 8A, a mask film 52 is newly formed on the wafer 110 for a flow path forming substrate, and patterned in a predetermined shape.

Figure 8B:
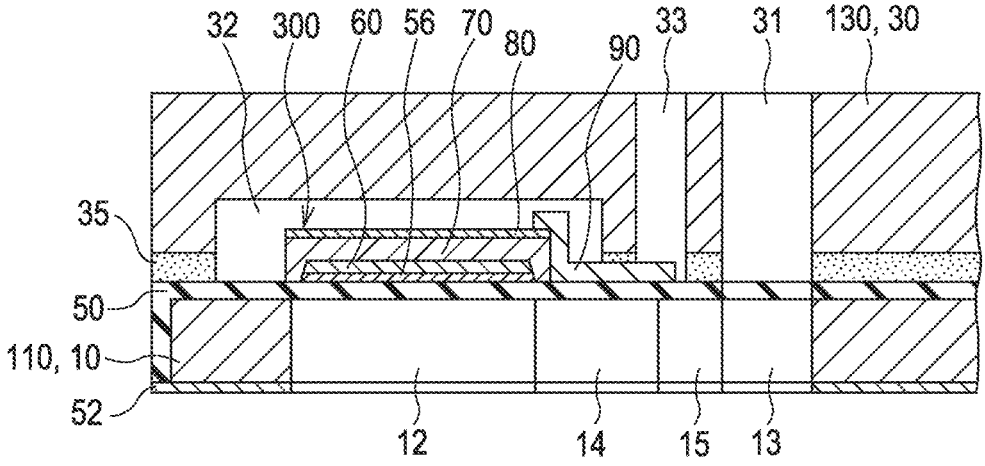
Figure 9A:
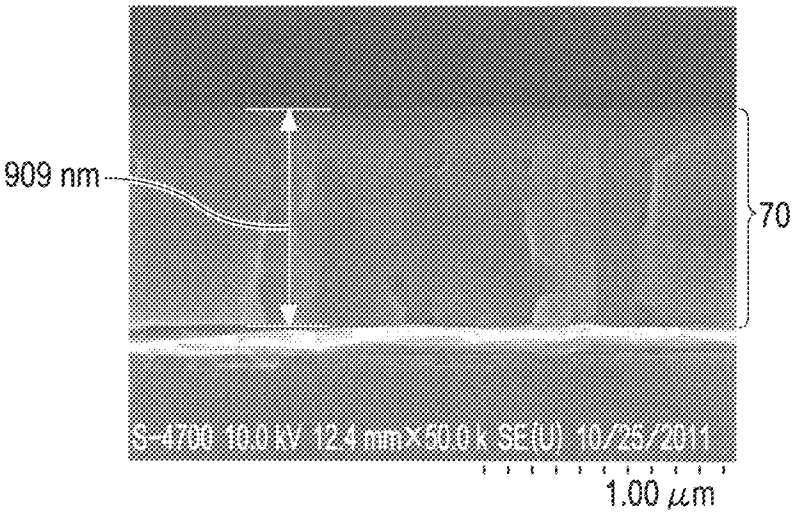
FIGS. 9A to 9D show pictures obtained by capturing cross sections of Examples 1 to 3 and Comparative Example 1 with an SEM.
Figure 9B:
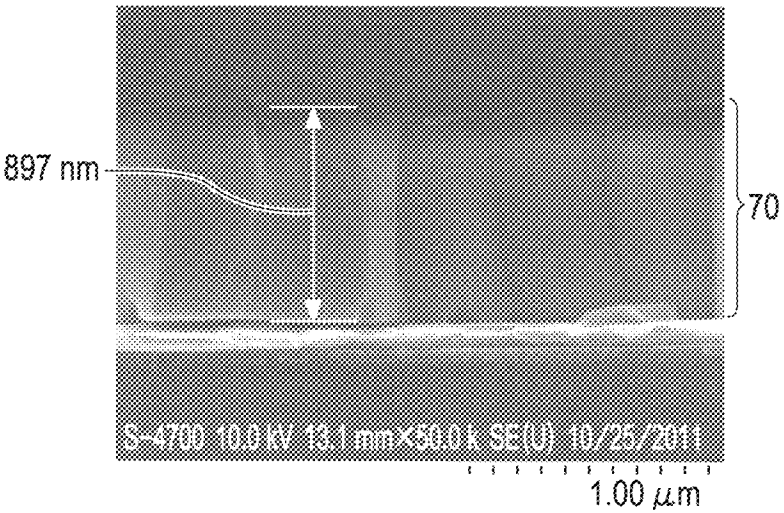
Figure 9C:
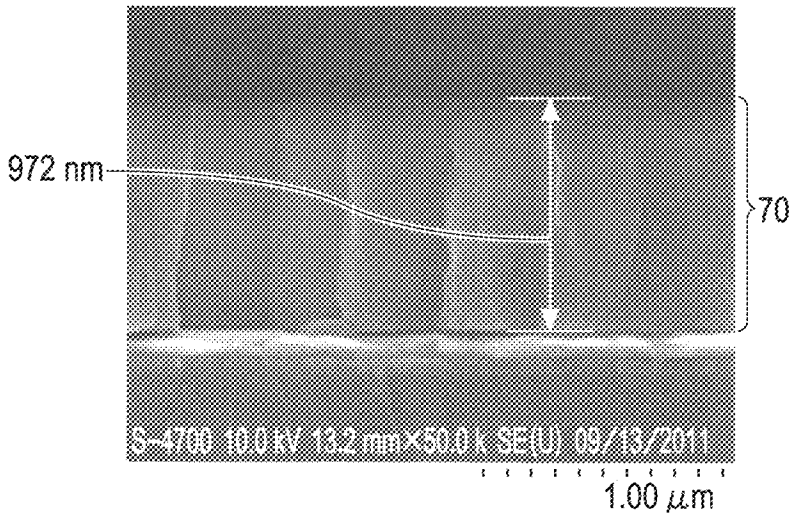
Figure 9D:
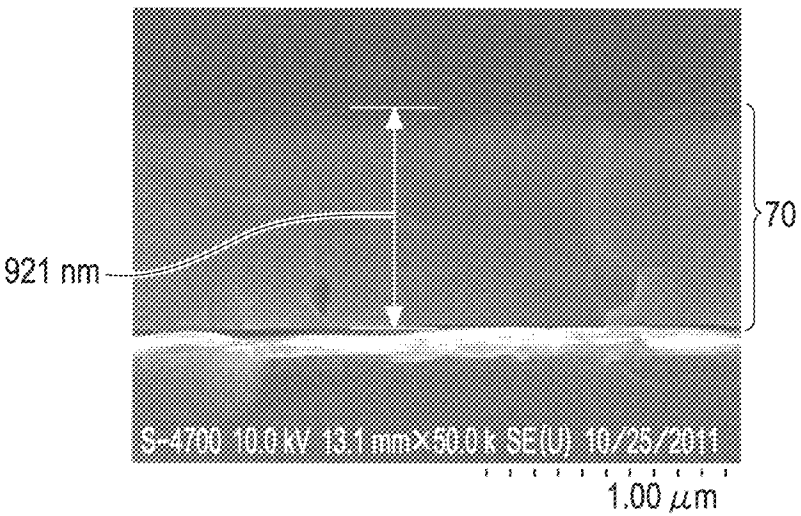
Figure 10B:
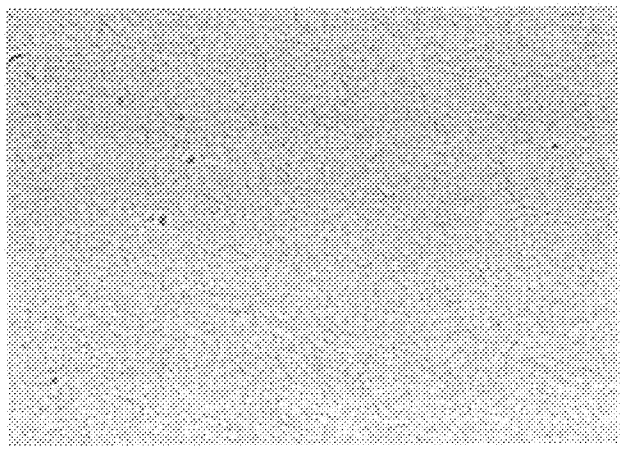
FIGS. 10A to 10D show pictures obtained by capturing surfaces of piezoelectric layers of Examples 1 to 3 and Comparative Example 1 with a metallograph.
Figure 10D:
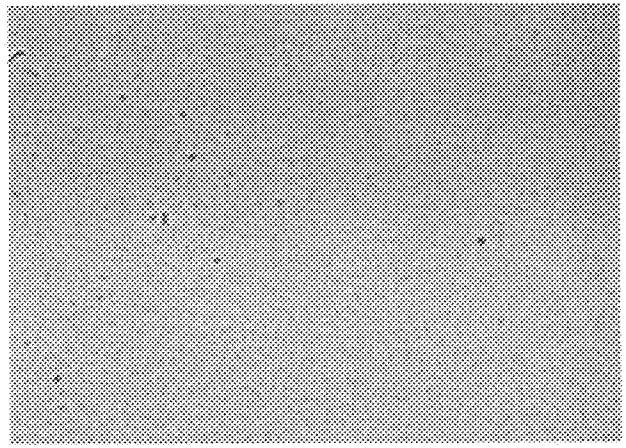
Figure 10A:
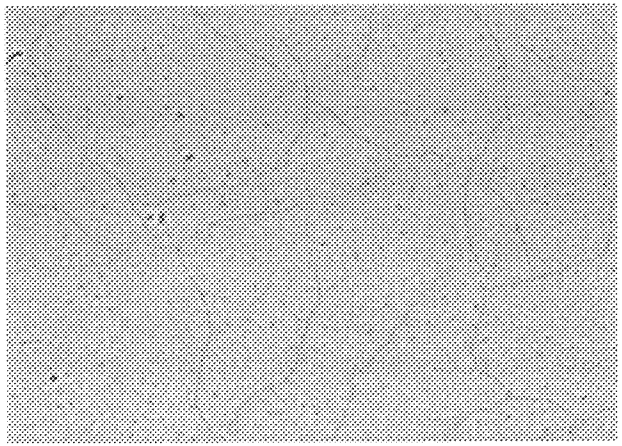
Figure 10C:
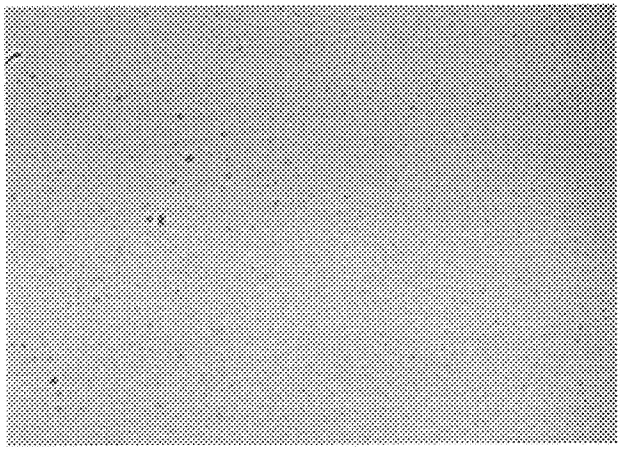

As shown in FIG. 8B, the pressure generating chamber 12, the communicating unit 13, the ink supply path 14, and the communicating path 15 corresponding to the piezoelectric element 300 are formed by performing anisotropic etching (wet etching) of the wafer 110 for a flow path forming substrate using an alkali solution such as KOH, through the mask film 52.

After that, unnecessary parts of the outer periphery portion of the wafer 110 for a flow path forming substrate and the wafer 130 for a protection substrate are removed by cutting, by dicing or the like, for example. After removing the mask film 52 on the surface of the wafer 110 for a flow path forming substrate on the side opposite to the wafer 130 for a protection substrate, the nozzle plate 20 on which the nozzle openings 21 are provided is adhered to the wafer thereof and the compliance substrate 40 is adhered to the wafer 130 for a protection substrate, and then, the wafer 110 for a flow path forming substrate is divided to the flow path forming substrate 10 and the like with one chip size shown in FIG. 1, and thus, the ink jet-type recording head I of the embodiment is obtained.

EXAMPLES

Hereinafter, Examples will be shown and the invention will be further described in detail. The invention is not limited to the following Examples.

Example 1

First, a silicon dioxide film having a thickness of 1170 nm was formed on a surface of a single-crystal silicon substrate oriented for (110) by thermal oxidation. Next, a titanium film having a thickness of 40 nm was formed on the silicon dioxide film by an RF magnetron sputtering method, and a titanium oxide film was formed by thermal oxidation. Then, a platinum film having a thickness of 100 nm was formed on the titanium oxide film with the RF magnetron sputtering method and was set as the first electrode 60.

Then, the piezoelectric layer 70 formed of a complex oxide which contains Bi, Ba, Fe, Mn, Ti, and Li and has a perovskite structure was formed on the first electrode 60. The method thereof is as follows. First, the first precursor solution was prepared by mixing each of n-octane solutions of bismuth 2-ethylhexanoate, barium 2-ethylhexanoate, iron 2-ethylhexanoate, manganese 2-ethylhexanoate, and titanium 2-ethylhexanoate, and by mixing so that a molar ratio of Bi, Ba, Fe, Mn, and Ti is Bi:Ba:Fe:Mn:Ti=75.0:25.0:71.25:3.75:25.0.

Then, after dropping the first precursor solution on the first electrode 60 and rotating at 500 rpm for six seconds, the first piezoelectric precursor film 71*a* was formed by a spin coating method by rotating the substrate at 3000 rpm for 20 seconds (first piezoelectric layer applying step). Next, the substrate was loaded on a hot plate and dried at 180° C. for two minutes (first piezoelectric layer drying step). Then, the substrate was loaded on the hot plate, and degreasing was performed at 350° C. for two minutes (first piezoelectric layer degreasing step). After repeating the step including the first piezoelectric layer applying step, the first piezoelectric layer drying step, and the first piezoelectric layer degreasing step three times, baking was performed in an oxygen atmosphere at 800° C. for five minutes by the RTA apparatus (first piezoelectric layer baking step). Then, the step described above was repeated three times, and the first piezoelectric layer 71 was formed by performing applying nine times totally.

Next, the second precursor solution was prepared by mixing each of n-octane solutions of bismuth 2-ethylhexanoate, barium 2-ethylhexanoate, iron 2-ethylhexanoate, manganese 2-ethylhexanoate, titanium 2-ethylhexanoate, and lithium 2-ethylhexanoate, and by mixing so that a molar ratio of Bi, Ba, Fe, Mn, Ti, and Li is Bi:Ba:Fe:Mn:Ti:Li=75.0:25.0:71.25:3.75:25.0:8.5.

Then, after dropping the second precursor solution on the first piezoelectric layer 71 and rotating at 500 rpm for six seconds, the second piezoelectric precursor film 72*a* was formed by a spin coating method by rotating the substrate at 3000 rpm for 20 seconds (second piezoelectric layer applying step). Next, the substrate was loaded on a hot plate and dried at 180° C. for two minutes (second piezoelectric layer drying step). Then, the substrate was loaded on the hot plate, and degreasing was performed at 350° C. for two minutes (second piezoelectric layer degreasing step). After repeating the step including the second piezoelectric layer applying step, the second piezoelectric layer drying step, and the second piezoelectric layer degreasing step three times, baking was performed in an oxygen atmosphere at 750° C. for five minutes by the RTA apparatus (second piezoelectric layer baking step).

After that, after forming a platinum film (second electrode 80) having a thickness of 100 nm as the second electrode 80 on the piezoelectric layer 70 by a DC sputtering method, a piezoelectric element was formed by performing baking at 700° C. for five minutes under $O_2$ flow using the RTA apparatus.

Example 2

The same operation as Example 1 was performed except for preparing the second precursor solution by mixing using n-octane solution of boron 2-ethylhexanoate instead of the n-octane solution of lithium 2-ethylhexanoate, so that a molar ratio of Bi, Ba, Fe, Mn, Ti, and B is Bi:Ba:Fe:Mn:Ti:B=75.0:25.0:71.25:3.75:25.0:3.0.

Example 3

The same operation as Example 1 was performed except for preparing the second precursor solution by mixing using n-octane solution of copper 2-ethylhexanoate instead of the n-octane solution of lithium 2-ethylhexanoate, so that a molar ratio of Bi, Ba, Fe, Mn, Ti, and Cu is Bi:Ba:Fe:Mn:Ti:Cu=75.0:25.0:71.25:3.75:25.0:8.5.

Comparative Example 1

The same operation as Example 1 was performed except for preparing the second precursor solution by mixing without using the n-octane solution of lithium 2-ethylhexanoate, so that a molar ratio of Bi, Ba, Fe, Mn, and Ti is Bi:Ba:Fe:Mn:Ti=75.0:25.0:71.25:3.75:25.0.

Test Example 1

Cross sections of the piezoelectric layers 70 immediately after the formation of the piezoelectric layers 70 before forming the second electrodes 80 in Examples 1 to 3 and Comparative Example 1 were observed by a scanning electron microscope (SEM) of 50,000 magnification. The result of Comparative Example 1, the result of Example 1, the result of Example 2, and the result of Example 3 are shown in FIG. 9A, FIG. 9B, FIG. 9C, and FIG. 9D, respectively.

As a result, in Examples 1 to 3 in which the second precursor solution including Li, B, or Cu was used, there were almost no holes and density of the film was high in the piezoelectric layer 70. In addition, in Examples 1 and 2 in which the second precursor solution including Li or B was used, columnar crystals were formed in the piezoelectric layer 70. On the other hand, in Comparative Example 1 in which the second precursor solution not including Li, B, or Cu was used, a plurality of holes were observed on the position or the like where the baking step was performed.

Test Example 2

Surfaces of the piezoelectric layers 70 after two weeks from the formation of the piezoelectric layers 70 before forming the second electrodes 80 in Examples 1 to 3 and Comparative Example 1 were observed by a metallograph of 500 magnifications, and generation of cracks on the piezoelectric layer 70 was checked. The result of Comparative Example 1, the result of Example 1, the result of Example 2, and the result of Example 3 are shown in FIG. 10A, FIG. 10B, FIG. 10C, and FIG. 10D, respectively.

As shown in FIGS. 10A to 10D, cracks were not observed in Examples 1 to 3 in which the second precursor solution including Li, B, or Cu was used, however, a plurality of cracks were observed in Comparative Example 1 in which the second precursor solution not including Li, B, or Cu was used.

Test Example 3

Figure 11:
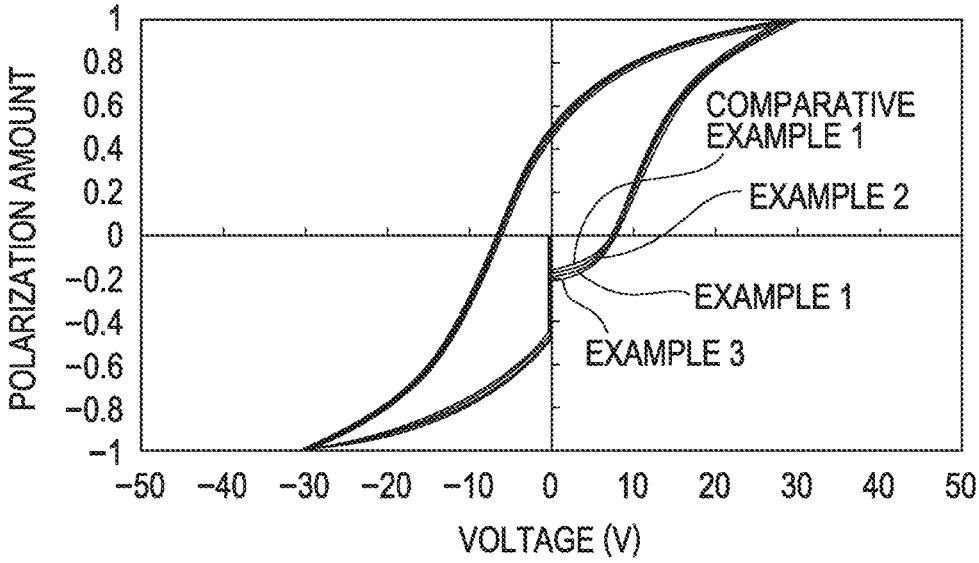
FIG. 11 shows a P-V curve of Examples 1 to 3 and Comparative Example 1.

A triangular wave with a frequency of 1 kHz at room temperature (25° C.) was applied to each piezoelectric element in Examples 1 to 3 and Comparative Example 1 with "FCE-1A" manufactured by TOYO Corporation using an electrode pattern with $\phi$=500 μm, to acquire a relationship between polarization amounts and voltage (P-V curve). The result thereof is shown in FIG. 11. In addition, FIG. 11 is a view normalized with the maximum polarization value as a reference. As shown in FIG. 11, all Examples 1 to 3 and Comparative Example 1 were checked to be ferroelectric, and depolarization was small in Examples 1 and 3 in which the second precursor solution including Li or Cu was used.

Test Example 4

Figure 12:
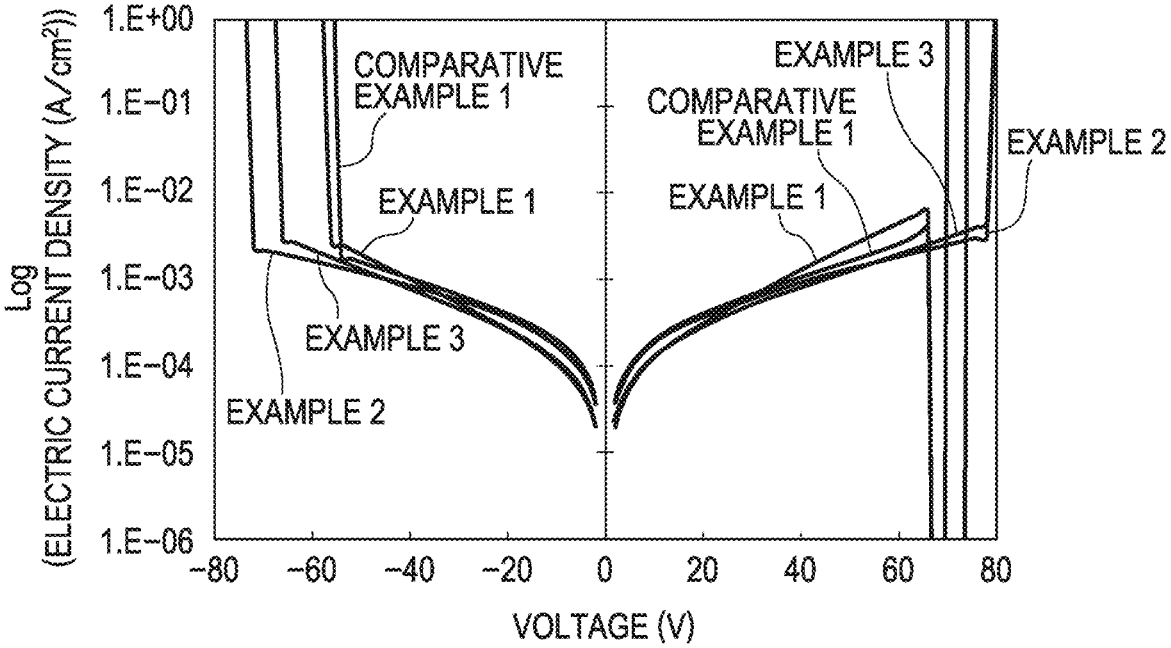
FIG. 12 shows an I-V curve of Examples 1 to 3 and Comparative Example 1.

A relationship between density of electric current and voltage (I-V curve) at room temperature (25° C.) of each piezoelectric element in Examples 1 to 3 and Comparative Example 1 was acquired using "4140B" manufactured by HP. The measurement was performed by using an electrode pattern with $\phi$=500 μm. The result thereof is shown in FIG. 12. As a result, in Examples 2 and 3 in which the second precursor solution including B or Cu was used, even when high voltage is applied, the piezoelectric element was not broken and pressure resistance was improved, compared to Comparative Example 1.

Example 4

The same operation as Example 1 was performed except for preparing the second precursor solution by mixing using n-octane solution of boron 2-ethylhexanoate and n-octane solution of copper 2-ethylhexanoate, so that a molar ratio of Bi, Ba, Fe, Mn, Ti, Li, B, and Cu is Bi:Ba:Fe:Mn:Ti:Li:B:Cu=75.0:25.0:71.25:3.75:25.0:4.5:3.0:1.0.

Test Example 5

Figure 13:
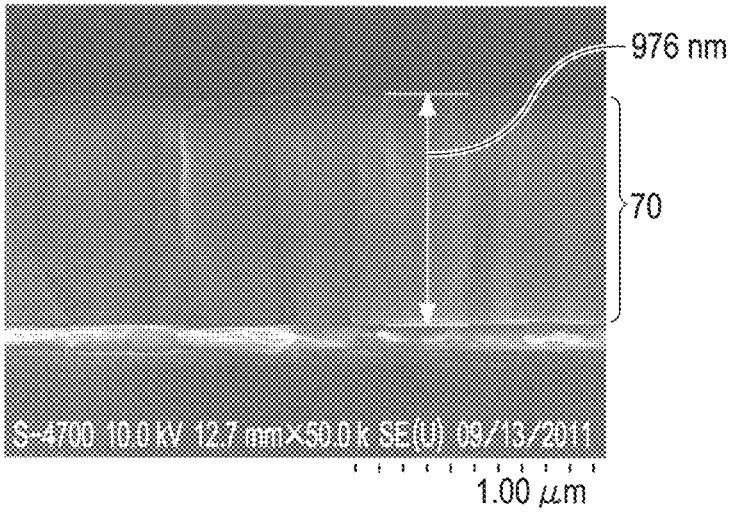
FIG. 13 shows a picture obtained by capturing a cross section of Example 4 with an SEM.

In the same manner as Test Example 1, a cross section of the piezoelectric layer 70 immediately after the formation of the piezoelectric layer 70 before forming the second electrode 80 in Example 4 was observed by a scanning electron microscope (SEM) of 50,000 magnifications. The result thereof is shown in FIG. 13. As a result, in Example 4 in which the second precursor solution including Li, B, or Cu was used, there were almost no holes and density of the film was high in the piezoelectric layer 70. In addition, in Example 4, columnar crystals were formed in the piezoelectric layer 70.

Test Example 6

Figure 14:
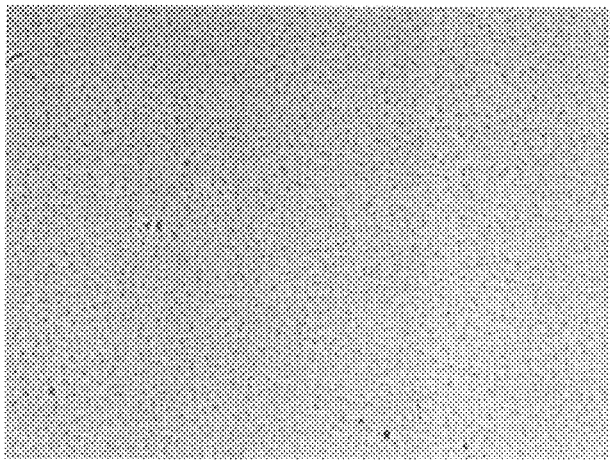
FIG. 14 shows a picture obtained by capturing a surface of a piezoelectric layer of Example 4 with a metallograph.

In the same manner as Test Example 2, a surface of the piezoelectric layer 70 after two weeks from the formation of the piezoelectric layer 70 before forming the second electrode 80 in Example 4 was observed by a metallograph of 500 magnifications, and generation of cracks on the piezoelectric layer 70 was checked. The result thereof is shown in FIG. 14. As shown in FIG. 14, in Example 4 in which the second precursor solution including Li, B, and Cu were used, cracks were not observed.

Test Example 7

Figure 15:
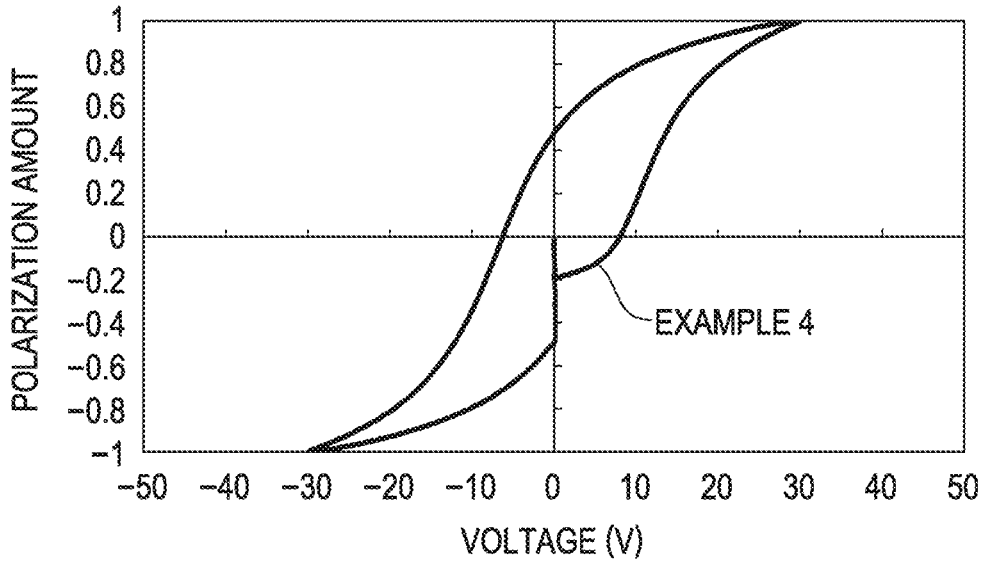
FIG. 15 shows a P-V curve of Example 4.

In the same manner as Test Example 3, a triangular wave with a frequency of 1 kHz at room temperature (25° C.) was applied to the piezoelectric element in Example 4 with "FCE-1A" manufactured by TOYO Corporation using an electrode pattern with $\phi$=500 μm, to acquire a relationship between polarization amounts and voltage (P-V curve). The result thereof is shown in FIG. 15. In addition, FIG. 15 is a view normalized with the maximum polarization value as a reference. As shown in FIG. 15, Example 4 was checked to be ferroelectric, and depolarization was small.

Test Example 8

Figure 16:
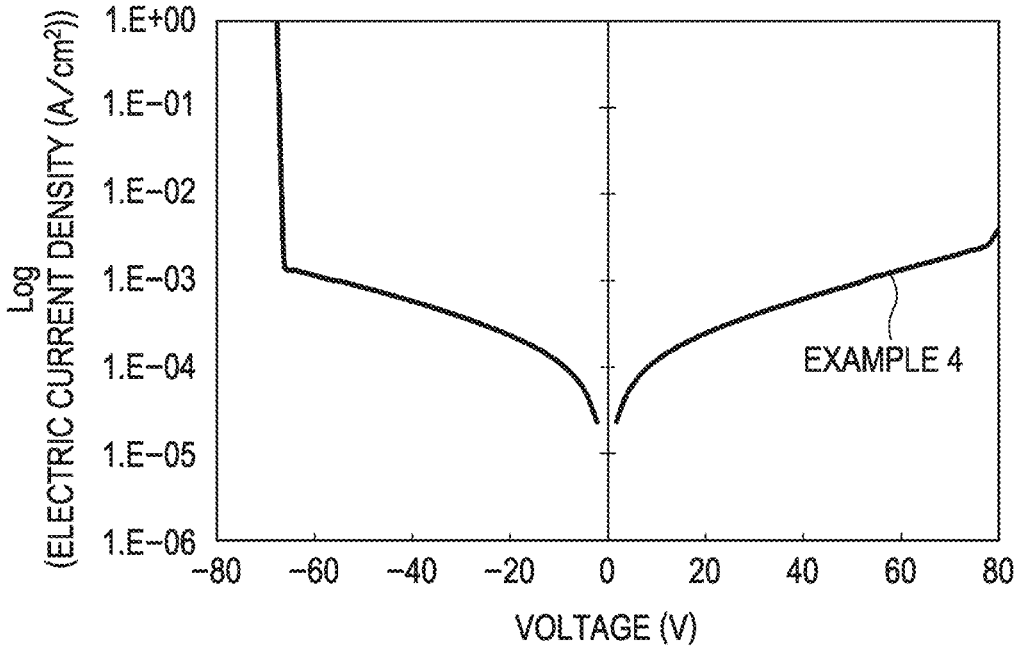
FIG. 16 shows an I-V curve of Example 4.

In the same manner as Test Example 4, a relationship between density of electric current and voltage (I-V curve) at room temperature (25° C.) of the piezoelectric element in Example 4 was acquired using "4140B" manufactured by HP. The measurement was performed by using an electrode pattern with $\phi$=500 μm. The result thereof is shown in FIG. 16. As a result, in Example 4 in which the second precursor solution including Li, B and Cu was used, even when high voltage is applied, the piezoelectric element was not broken and pressure resistance was improved, compared to Comparative Example 1.

Test Example 9

Figure 17:
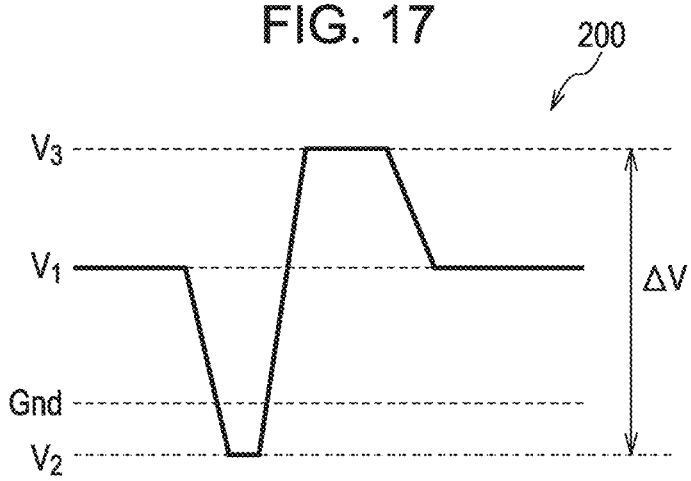
FIG. 17 shows a driving waveform used in Test Example 9.
Figure 18:
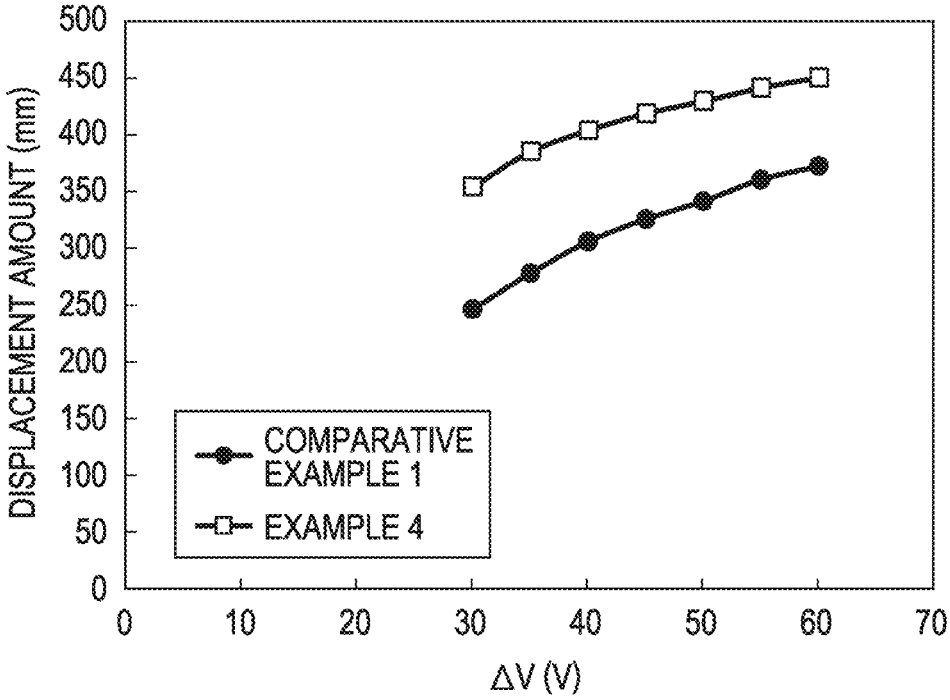
FIG. 18 is a view showing a measurement result of amounts of displacement of Example 4 and Comparative Example 1.

Amounts of displacement when applying a driving waveform 200 shown in FIG. 17 to the second electrode 80 for each piezoelectric element in Example 4 and Comparative Example 1 were acquired with the first electrode 60 as reference potential (noted as "Gnd" in FIG. 17). The amounts of displacement were measured at a room temperature (25° C.) using a laser Doppler displacement meter manufactured by Graphtec Corporation. In addition in the driving waveform 200 shown in FIG. 17, an upper side with respect to the reference potential (Gnd) is a positive voltage, and a lower side with respect to the reference potential (Gnd) is a negative voltage. $V_1$ is voltage (intermediate voltage) applied in a standby state. In the Test Example, ΔV is changed from 30 V to 70 V by fixing $V_1$=20 V and $V_2$=−10 V and changing $V_3$ from 20 V to 60 V with intervals of 5 V, and each of amounts of displacement were acquired. The result thereof is shown in FIG. 18. As a result, as shown in FIG. 18, the amount of displacement in Example 4 was significantly larger than Comparative Example 1, when comparing with the same voltage.

Test Example 10

For piezoelectric element of Examples 1 to 4 and Comparative Example 1, X-ray diffraction pattern of the piezoelectric layer 70 was acquired at a room temperature (25° C.) using a CuKα line as an X-ray source, by "D8 Discover" manufactured by Bruker Corporation. As a result, in Examples 1 to 4 and Comparative Example 1, a peak caused by a perovskite structure and a peak derived from the substrate were observed, and peculiarity was not observed.

Other Embodiments

Hereinabove, the embodiment of the invention has been described, however, a basic configuration of the invention is not limited thereto. For example, in the embodiment described above, the silicon single-crystal substrate was used as the flow path forming substrate 10, however it is not particularly limited thereto, and a SOI substrate, or a material such as glass may be used, for example.

Figure 19:
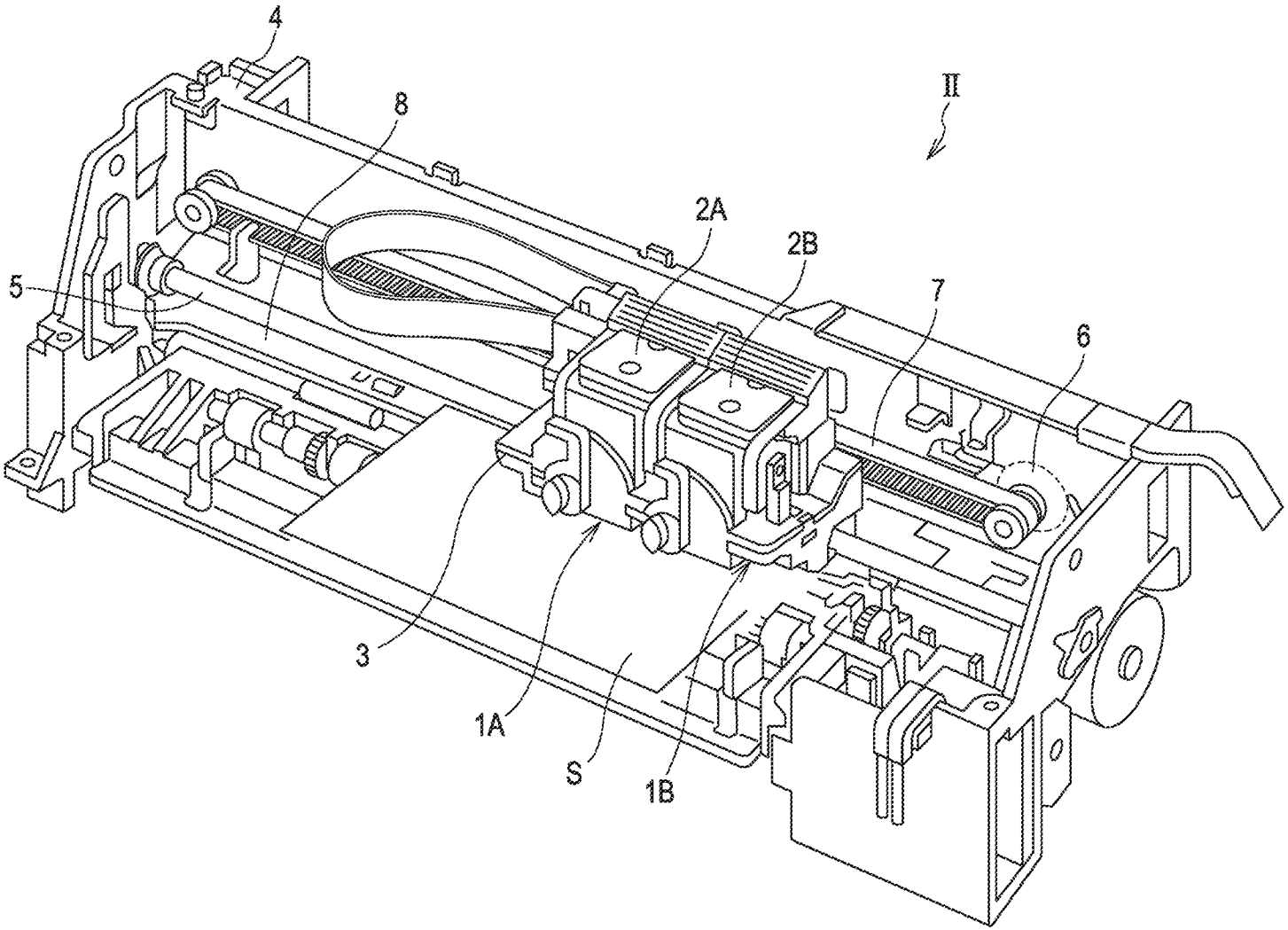
FIG. 19 is a view showing a schematic configuration of a recording apparatus according to an embodiment of the invention.

In addition, the ink jet-type recording head of the embodiment configures a part of a recording head unit including an ink flow path communicating with an ink cartridge or the like, and is loaded on an ink jet-type recording apparatus. FIG. 19 is a schematic view showing an example of the ink jet-type recording apparatus.

In an ink jet-type recording apparatus II shown in FIG. 19, cartridges 2A and 2B configuring ink supply units are detachably provided in recording head units 1A and 1B including the ink jet-type recording head I, and a carriage 3 on which the recording head units 1A and 1B are loaded is provided on a carriage axis 5 provided on an apparatus main body 4, to be movable in an axis direction. For example, the recording head units 1A and 1B discharge a black ink composition and a color ink composition, respectively.

The carriage 3 on which the recording head units 1A and 1B are loaded is moved along the carriage axis 5, by transferring a driving force of a driving motor 6 to the carriage 3 through a plurality of toothed wheels (not shown) and a timing belt 7. On the other hand, a platen 8 is provided on the apparatus main body 4 along the carriage axis 5, and a recording sheet S which is a recording medium such as a paper fed by a paper feeding roller (not shown) is wound on the platen 8 and transported.

In addition, in the embodiment described above, the ink jet-type recording head has been described as an example of a liquid ejecting head, however, the invention is for general liquid ejecting heads, and can be also applied to a liquid ejecting head which ejects liquid other than ink. As the other liquid ejecting heads, for example, various recording heads used for an image recording apparatus such as a printer, a color material ejecting head used for manufacturing a color filter such as a liquid crystal display, an electrode material ejecting head used for electrode formation in an organic EL display or an FED (Field Emission Display), a bioorganic ejecting head used for manufacturing bio chip, and the like are used.

In addition, the piezoelectric element according to the embodiment is not limited to the piezoelectric element used for the liquid ejecting head, however, it can also be used for the other devices. As the other devices, for example, an ultrasonic device such as an ultrasonic transmitter, an ultrasonic motor, a temperature-electricity transducer, a pressure-electricity transducer, a ferroelectric transistor, a piezoelectric transformer, and filters such as a cutoff filter of harmful rays such as an infrared ray, an optical filter using a photonic crystal effect due to formation of quantum dot, and an optical filter using coherency of light of a thin film are used. In addition, the invention can also be applied to a piezoelectric element used as a sensor and a piezoelectric element used as a ferroelectric memory. As a sensor used by a piezoelectric element, an infrared sensor, an ultrasonic sensor, a thermosensitive sensor, a pressure sensor, a pyroelectric sensor, and a gyro sensor (angular velocity sensor) are used.

What is claimed is:

1. A method of manufacturing a piezoelectric element including a piezoelectric layer and an electrode, the method comprising:

forming a first piezoelectric precursor film containing Bi, Fe, Ba and Ti;

forming a first piezoelectric layer by heating and crystallizing the first piezoelectric precursor film;

forming a second piezoelectric precursor film containing Bi, Fe, Ba, Ti and B; and forming the piezoelectric layer by heating and crystallizing the first piezoelectric layer and the second piezoelectric precursor film.

2. The method of manufacturing a piezoelectric element according to claim 1, wherein the piezoelectric layer further contains Mn.

3. The method of manufacturing a piezoelectric element according to claim 1, wherein during the step of heating and crystallizing the first piezoelectric layer and the second piezoelectric precursor film, the first piezoelectric layer is liquefied and elements from the second piezoelectric precursor film are diffused into the first piezoelectric layer.

4. A piezoelectric element manufactured by the method of manufacturing a piezoelectric element according to claim 1.

5. A liquid ejecting head comprising the piezoelectric element manufactured by the method of manufacturing the piezoelectric element according to claim 1.

6. A liquid ejecting apparatus comprising the piezoelectric element manufactured by the method of manufacturing the piezoelectric element according to claim 1.

7. A method of manufacturing a piezoelectric element including a piezoelectric layer and an electrode, the method comprising:

forming a first piezoelectric precursor film containing Bi, Fe, Ba and Ti;

forming a first piezoelectric layer by heating and crystallizing the first piezoelectric precursor film;

forming a second piezoelectric precursor film containing Bi, Fe, Ba, Ti and Cu; and forming the piezoelectric layer by heating and crystallizing the first piezoelectric layer and the second piezoelectric precursor film.

8. The method of manufacturing a piezoelectric element according to claim 7, wherein the piezoelectric layer further contains Mn.

9. The method of manufacturing a piezoelectric element according to claim 7, wherein during the step of heating and crystallizing the first piezoelectric layer and the second piezoelectric precursor film, the first piezoelectric layer is liquefied and elements from the second piezoelectric precursor film are diffused into the first piezoelectric layer.

10. A piezoelectric element manufactured by the method of manufacturing a piezoelectric element according to claim 7.

11. A liquid ejecting head comprising the piezoelectric element manufactured by the method of manufacturing the piezoelectric element according to claim 7.

12. A liquid ejecting apparatus comprising the piezoelectric element manufactured by the method of manufacturing the piezoelectric element according to claim 7.

13. A method of manufacturing a piezoelectric element including a piezoelectric layer and an electrode, the method comprising:

forming a first piezoelectric precursor film containing Bi, Fe, Ba and Ti;

forming a first piezoelectric layer by heating and crystallizing the first piezoelectric precursor film;

forming a second piezoelectric precursor film containing Bi, Fe, Ba, Ti and Li; and forming the piezoelectric layer by heating and crystallizing the first piezoelectric layer and the second piezoelectric precursor film.

14. The method of manufacturing a piezoelectric element according to claim 13, wherein the piezoelectric layer further contains Mn.

15. The method of manufacturing a piezoelectric element according to claim 13, wherein during the step of heating and crystallizing the first piezoelectric layer and the second piezoelectric precursor film, the first piezoelectric layer is liquefied and elements from the second piezoelectric precursor film are diffused into the first piezoelectric layer.

16. A piezoelectric element manufactured by the method of manufacturing a piezoelectric element according to claim 13.

17. A liquid ejecting head comprising the piezoelectric element manufactured by the method of manufacturing the piezoelectric element according to claim 13.

18. A liquid ejecting apparatus comprising the piezoelectric element manufactured by the method of manufacturing the piezoelectric element according to claim 13.

* * * * *